US011439237B2

(12) United States Patent
Black

(10) Patent No.: US 11,439,237 B2
(45) Date of Patent: Sep. 13, 2022

(54) FOLDING CHAIR

(71) Applicant: Marcus Black, Leeds (GB)

(72) Inventor: Marcus Black, Leeds (GB)

( * ) Notice: Subject to any disclaimer, the term of this patent is extended or adjusted under 35 U.S.C. 154(b) by 0 days.

(21) Appl. No.: 17/048,150

(22) PCT Filed: Apr. 18, 2019

(86) PCT No.: PCT/GB2019/051109
§ 371 (c)(1),
(2) Date: Oct. 16, 2020

(87) PCT Pub. No.: WO2019/202331
PCT Pub. Date: Oct. 24, 2019

(65) Prior Publication Data

US 2021/0212469 A1 Jul. 15, 2021

(30) Foreign Application Priority Data

Apr. 19, 2018 (GB) ..... 1806363

(51) Int. Cl.
*A47C 4/14* (2006.01)
*A47C 4/12* (2006.01)
*A47C 4/22* (2006.01)
*A47C 4/24* (2006.01)

(52) U.S. Cl.
CPC ..... *A47C 4/14* (2013.01); *A47C 4/12* (2013.01); *A47C 4/22* (2013.01); *A47C 4/24* (2013.01)

(58) Field of Classification Search
CPC .. A47C 4/04; A47C 4/08; A47C 5/005; A47C 4/025; A47C 4/14; A47C 4/12
See application file for complete search history.

(56) References Cited

U.S. PATENT DOCUMENTS 1,396,794 A 11/1921 Travers
2,649,147 A * 8/1953 Sanford ..... A47C 5/04 297/411.41
4,123,101 A 10/1978 Minsker
4,202,581 A * 5/1980 Fleishman ..... A47C 4/021 108/159
10,136,730 B2 * 11/2018 Kim ..... A47C 3/04
(Continued)

FOREIGN PATENT DOCUMENTS

CN 202775190 U 3/2013
CN 206137650 U 5/2017
(Continued)

OTHER PUBLICATIONS

International Search Report for International Application No. PCT/GB2019/051109, dated Jun. 28, 2019 (6 pages).
(Continued)

*Primary Examiner* — Sarah B McPartlin
(74) *Attorney, Agent, or Firm* — Kagan Binder, PLLC

(57) ABSTRACT

A folding chair (100) comprises as main components a mainframe (1), a seat (2) and a back leg support (3). At least one of the main components is uniplanar and the others fit within a plane of the at least one main component when the chair (100) is collapsed. The folding chair (100) uses a type A construction, and forward movement of the top of the seat (2) relative to the mainframe (1) causes the back leg support (3) to move backwards relative to the mainframe (1).

20 Claims, 18 Drawing Sheets

(56) References Cited

U.S. PATENT DOCUMENTS

| | | | | |
|---|---|---|---|---|
| 10,485,349 | B1 * | 11/2019 | Grandberg | A47C 4/10 |
| D870,480 | S * | 12/2019 | Grandberg | D6/368 |
| 2004/0004371 | A1 | 1/2004 | Noor | |
| 2015/0289657 | A1 | 10/2015 | Gendell | |
| 2017/0188712 | A1 * | 7/2017 | Ehlinger | A47C 9/06 |
| 2020/0046122 | A1 * | 2/2020 | Ogg | A47C 4/24 |

FOREIGN PATENT DOCUMENTS

| | | | |
|---|---|---|---|
| DE | 801220 | C | 12/1950 |
| DE | 8434844 | U1 | 2/1985 |
| DE | 9316227 | U1 | 1/1994 |
| DE | 212014000267 | U1 | 11/2017 |
| JP | H06269331 | A | 9/1994 |
| WO | 9727786 | A1 | 8/1997 |

OTHER PUBLICATIONS

Search Report for GB Application No. GB1806363.6, dated Oct. 29, 2018 (2 pages).

* cited by examiner

FOLDING CHAIR

CROSS-REFERENCE TO RELATED APPLICATIONS

This application claims benefit from International Application No. PCT/GB/2019/051109, filed Apr. 18, 2019, which in turn claims priority from Great Britain Application having serial number 1806363.6, filed on Apr. 19, 2018, both of which are incorporated herein by reference in their entireties for all purposes.

BACKGROUND

Folding chairs and stools are well known and are generally used for occasions and events where permanent seating is not possible or practical. They are commonly used in the home when extra seating is required as they have the advantage of taking up less space than a chair of fixed design and can be stored when not in use.

Folding chairs and stools can be broadly placed into two categories.

The first type has a seat and/or backrest made of a flexible material e.g. canvas or leather, with a collapsible frame made from rigid materials. This type of folding chair is commonly used outdoors, for camping and the like. The classic deck chair would fall into this category.

The second type of folding chair uses a rigid back and seat, commonly made from timber, pressed steel or injection-moulded plastic (sometimes reinforced with a metal frame). Other parts are made from metal (usually steel tubing) or timber. The seat and back may be constructed of a rigid frame, made of bent steel tubing or other suitable material/method, with flexible material, such as canvas, stretched tightly over the frame and fixed to the frame (or wrapped tightly around the frame and ends of the flexible material sewn together); however, this is analogous to a rigid back and seat, as the combination of rigid frame and canvas simply replaces a seat or back component made completely from rigid materials. The rigid seat and back components form part of the mechanism and structure of the chair, allowing it to expand and collapse. The present invention relates to folding chairs using a rigid back and/or seat.

In most folding chairs with rigid backs and seats, the front legs and back frame usually comprise one component which, for the purpose of this disclosure, is named the mainframe. The mainframe is typically fabricated from one length (or more) of bent steel tubing, or a number of smaller parts joined together, as in a chair made from timber.

Folding chairs with rigid backs and seats can be further categorised into two classes, multi-plane folding chairs (MPFCs) and uni-plane folding chairs (UPFCs).

FIG. 1 shows a side elevation of a typical folding chair. It comprises a mainframe 1, a seat 2, a back leg support 3 and a backrest 4. Seen from a plan view the mainframe and back legs lie directly over each other when the chair is in its folded state. In other words, when the folded chair is viewed from a plan view, at least two main components lie partially or wholly over each other. As such the main components of the chair do not tessellate with each other when viewed from a plan view but instead overlap. When viewed in a side view the components of MPFCs do not lie in a single plane and the chair can be said to be more than one component in depth. In other words, when the folded chair is viewed from a side view, the main components take up more than one spatial plane. The main components of this type of chair do not tesselate with each other when the chair is in the folded state but instead overlap in multiple planes, hence multi-plane folding chairs (MPFCs).

Most folding chairs are MPFCs. The mainframe and back leg component are usually made of bent steel tubing with the seat and back made of either pressed steel, moulded plastic (sometimes reinforced with a steel frame) or timber. Some MPFCs (such as café style folding chairs) are made using a fabricated solid steel mainframe and back leg components, with a steel frame and slats used for the seat and back. Other MPFCs are made of solid timber for the mainframe and back leg component, with a timber frame and slats for the seat and timber backrest.

Uni-plane folding chairs (UPFCs) have the main components nested within one spatial plane. When viewed in a folded state from a plan view, some UPFCs can be said to be comprised of main components which tessellate. In this specification, the term "tessellate" means that the shapes of the components of the chair fit together, preferably with no spaces in between the components save to the extent required for operation of the chair. Like terms should be understood in a like manner. It should be noted that not all tessellated chairs are uniplanar, and not all uniplanar chairs are tessellated.

FIG. 2 shows a side elevation of a typical UPFC, showing just the edge of the mainframe component 1. FIG. 7 shows a side elevation and a front elevation of one such UPFC, illustrating how the seat 2 and back leg component 3 may fit inside the mainframe 1. The UFPC shown in FIG. 7 can be said to be tessellated within the meaning of this specification. A UPFC's side elevation will typically only show the edge of the mainframe 1, as the other main parts are of typically of identical thickness to the mainframe 1, hence the term uni-plane folding chairs (UPFCs).

The term uni-plane folding chair may be further understood to mean that when the chair is viewed in a folded/collapsed state from a plan view, the main components of UPFCs, such as the mainframe 1, seat 2, back leg 3, do not overlap with each other. The components of the chair in FIG. 7 should also be understood to "tessellate" with each other. The main components can then move perpendicular to the single plane without disturbing any other components. In this case "tessellate" should be understood to mean that each of the components (tiles) of the UPFC fit together seamlessly, when the chair is in a folded state, such that all of the components (tiles) lie in a single plane (when viewed from a side view) and do not overlap. This is also true for the connecting portions of UPFCs, which conceal the connecting components in the single plane, when viewed from a side view. This may allow UPFCs to open both ways and expand from a folded state. There are only very small gaps between components to allow the UPFC to expand and be moveable.

UPFCs have a functional advantage over MPFCs, as they are usually much thinner when in their collapsed state (typically around 20-25 mm as opposed to around 80 mm) allowing for more chairs to be stored in a given space. The present invention further relates to UPFCs.

The two most commonly used folding systems have been named Type A and Type X. FIG. 3 shows a side elevation of a conventional MPFC using the Type A folding system in its collapsed state. FIG. 4 shows a side elevation of the MPFC using the Type A system in its expanded state. The Type A system is characterised by the use of a mainframe 1, seat 2, back leg component 3, and backrest 4, with the back leg component 3 connected to the mainframe 1 by a pin 5 positioned near the top of the chair, which allows the back leg component 3 to pivot freely against the mainframe 1. The seat 2 is connected to the mainframe 1 with a further pin 6 situated near the centre of the seat 2, which allows the seat 2 to pivot freely against the mainframe 1. The seat 2 is also connected to the back leg component 3 using a rod or dowel 7, which is free to move up and down within a slot 8 found in the back leg component 3.

To expand this type of chair, the user pushes the front of the seat outwards as shown by arrow a in FIG. 3, which causes the seat 2 to pivot around the mainframe 1. This in turn causes the pin/dowel 7 to move in the direction indicated by arrow b and upwards within the slot 8, resulting in the back leg component 3 moving outwards, in the direction of arrow c. To collapse the chair, the user pushes the seat 2 to its original position.

FIG. 5 shows a side elevation of a conventional MPFC using the Type X folding system in its collapsed state. FIG. 6 shows a side elevation of the MPFC using the Type X system in its expanded state. The Type X folding system is also characterised by the use of a mainframe 1, seat 2, back leg component 3, and backrest 4. However, the way the components are connected differs significantly, with the back leg component 3 connected to the mainframe 1 by a pin 5 positioned near the lower end of the chair, which allows the back leg component 3 to pivot freely against the mainframe 1. The front end of the seat 2 is connected to the back leg component 3 with a pin 6, which allows the seat 2 to pivot freely against the back leg component 3. The back edge of the seat 2 is connected to the mainframe 1 using a rod or dowel 7, which is free to move up and down within a slot 8 found in the mainframe 1. This type of chair typically has an X configuration under the seat when the chair is expanded.

To expand a chair using a Type X folding system, the user pushes the back of the seat downwards, shown by arrow a in FIG. 5, causing the rod/dowel 7 to slide downwards within the slot 8. This causes the front of the seat 2 to push the top of the back leg component 3 forwards, shown by arrow b, which rotates the back leg component 3 around pivot point 5, causing the bottom of the back leg component 3 to move in the direction indicated by arrow c. To collapse the chair, the seat 2 is returned to its original position.

The Type A system has the advantage that the mainframe can be kept as a straight component, unlike Type X chairs, due to the relatively high pivot point between it and the back leg component. On many type A system chairs the backrest is angled slightly to improve comfort.

By contrast, due to the low pivot point between the mainframe and the back leg component, the mainframe in Type X system chairs is almost always bent towards the centre of the chair in order to make the chair more ergonomic (see mainframe 1 in FIG. 6). This has the negative affect of making the overall depth of the chair greater when in its collapsed state.

MPFCs generally use both Type A and Type X folding systems. Substantially all conventional UPFCs use a Type X folding system, a folding system based on the Type X system, a more complex system, or a system that does not link or coordinate the main components, requiring the user to fit one part into another part of the chair, as in the system shown in FIG. 7, where the seat 2 and back leg 3 are pivoted against the mainframe 1, to allow the top edge of the back leg component 3 to be located into the slot 2A, within the seat 2. However, where Type X UPFCs are used, they may be uncomfortable because the backrest is too far back. To counter this, the pivot point may be brought upwards or forwards to bring the back rest further forward, but this has the disadvantage that the seat becomes less stable. Alternative attempts to solve this problem have either resulted in a system that is too complicated and/or expensive to manufacture, too complicated to use or is not truly uni-planar.

Shortcomings of existing UPFCs include some or all of the following:

- a large number of components used (both main parts and smaller components)
- a complex folding system
- issues associated with the type X system (requiring the mainframe to be bent, or for the use of a swivelling back-rest)
- inconvenience of more than one movement required to expand and collapse the chair
- relatively large overall thickness
- too many machining processes required
- too many visible smaller components (hinges, rods, brackets etc.)

SUMMARY OF THE INVENTION

The present invention aims to provide a UPFC that addresses some or all of the shortcomings of existing UFPCs.

According to the present invention, there is provided a folding chair comprising as main components a mainframe, a seat and a back leg support, wherein: at least one of said main components is substantially uniplanar and the other said main components fit within a plane of the at least one main component when the chair is collapsed; and the folding chair uses a type A system, wherein forward movement of the top of the seat relative to the mainframe causes the back leg support to move backwards relative to the mainframe.

Preferably, the mainframe comprises front legs and seat supports extending downwards, the front legs extend further down than the seat supports, and the seat is pivotally attached to the seat supports.

More preferably, the seat supports extend at least halfway down the length of the seat when the chair is collapsed.

It is also more preferable that the back leg support comprises a pair of back legs, each of which is disposed between a corresponding front leg and seat support when the chair is collapsed.

It is also more preferable that the back leg support is pivotally mounted to the front legs; the seat is pivotally mounted to the seat supports; and the seat is pivotally and slidably mounted to the back leg support.

Preferably, the mainframe comprises a backrest and front legs extending downwards from the outer sides of the backrest, whereby the back leg support is disposed inwards of the front legs when the chair is collapsed.

Preferably, the seat and the back leg support are nested within the mainframe when the chair is collapsed such that when viewed from a plan view the back leg support and the mainframe do not overlap.

Preferably, the mainframe comprises front legs extending downwards, the back leg support is pivotally attached to upper pivot points adjacent to the front legs, and the seat is pivotally attached to the front legs below the upper pivot points.

In this case, it is preferred that the back leg support comprises a pair of back legs, and the front legs are disposed inwards of the arms when the chair is collapsed.

Preferably, the seat is pivotally and slidably mounted to the back leg support.

Preferably, the front legs on either side of the chair are joined by a connecting portion extending between them at either or both the top or the bottom of the chair when collapsed.

In this case, it is preferred that the front legs are joined by a backrest.

It is also preferred that the front legs are joined by a front leg connecting area extending between the bottoms of the respective front legs.

Preferably, the mainframe, the seat and the back leg support form a substantially flat surface on at least one side when the chair is collapsed.

Preferably, a maximum gap between any of the mainframe, the seat and the back leg support when the chair is collapsed is less than 3 mm, preferably 2 mm and more preferably 1 mm.

Preferably, a maximum thickness of the chair when collapsed is 30 mm, preferably 15 mm and more preferably 8 mm.

Preferably, the chair can be opened in either direction.

Preferably, each of the mainframe, the back leg support and the seat is integrally formed.

Preferably, one sheet of material is used to form all the mainframe, the back leg support and the seat.

Preferably, an image is formed on one of the main surfaces of the chair when collapsed.

Preferably, components of the chair overlap in an area in plan view of 5% or less of the area of the chair, preferably 1% or less, more preferably 0.5% or less, more preferably 0.1% or less, and more preferably 0%.

Preferably, the chair comprises folding arms connected to the mainframe.

Preferably, the folding arms are formed from at least one piece of material.

Preferably, the folding arms are connected to the mainframe by a connection means, preferably a hinge.

Preferably, the folding arms are formed of an arm support, the central portion cut out of the folding arm, and an outer portion, which surrounds the central portion, wherein the central portion and the outer portion are connected together.

Preferably, in a collapsed state, the folding arms lie on top of the mainframe in a plane above the plane of the mainframe.

Preferably, in an expanded state, the folding arms form a substantially triangular shape with the mainframe.

Preferably, the front legs and back legs are shaped such that there are a plurality of points of contact with the floor.

Preferably, the points of contact with the floor are rounded and/or have synthetic inserts attached to them.

Preferably, the arms rests and arm supports are integrally formed with the mainframe and seat.

Preferably, the arm supports are pivotally connected to the seat and the arm rests and the arm rests are pivotally connected to the mainframe and the arm supports.

Preferably, the chair is configured to be opened in a forward or backward direction.

Preferably, the back rest is configured to be tiltable.

Preferably, the chair has a fully skeletal structure.

Preferably, the chair has a partially skeletal structure.

Preferably, the skeletal structure is formed by removing shapes of material from at least one of the main components of the chair.

Preferably, at least one of the main components of the chair are frames.

Preferably, the material removed from the main components form recesses in at least one side of the main components or extend all of the way through the main components.

Preferably, at least one panel is detachably fitted to the full or partial skeletal structure of the chair.

Preferably, magnetic components, comprised of a first magnet and a second magnet, are placed on opposing side edges of the main components and/or the back rest.

Preferably, a wall mounting means.

Preferably, the wall mounting means is a hole or hook.

Preferably, the wall mounting means is formed using the material created from cutting out a handle-hole.

Preferably, the wall mounting means has a slight lip to the upper edge.

BRIEF DESCRIPTION OF THE DRAWINGS

Embodiments of the invention will now be described by way of example only, with reference to the accompanying drawings, in which.

DESCRIPTION OF THE INVENTION

The first embodiment of the invention is a UPFC which employs a Type A folding mechanism—in other words, the pivot point between the back legs and the mainframe is above the seat when the chair is in the expanded state. The mechanism has been integrated into a single, flat sheet of material. In order to achieve this, the main parts are configured to fit into each other with substantially no gaps between the main parts, apart from those made by the cutting process. This configuration allows the chair 100 to function perfectly and overcome the problems mentioned earlier.

Figure 1:
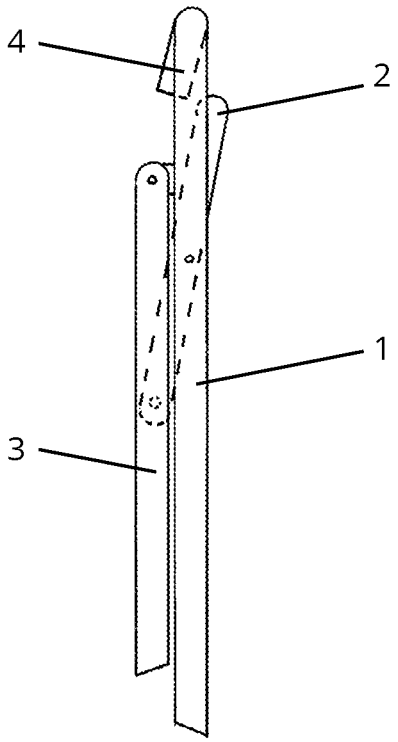
FIG. 1 is a side elevation of a conventional MPFC in its collapsed state
Figure 2:
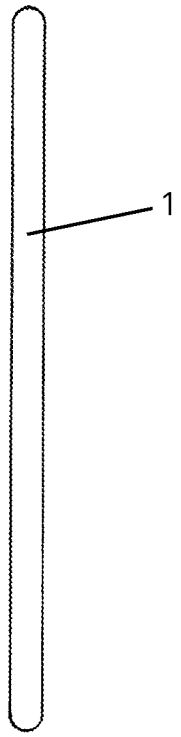
FIG. 2 is a side elevation of a conventional UPFC in its collapsed state
Figure 3:
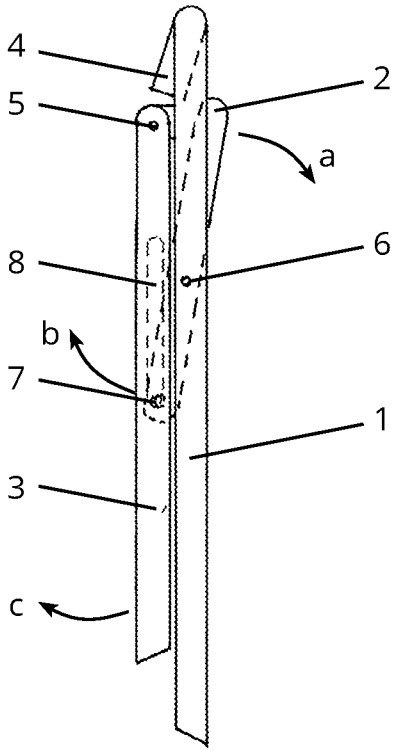
FIG. 3 is a side elevation of a conventional MPFC in its collapsed state using a Type A system
Figure 4:
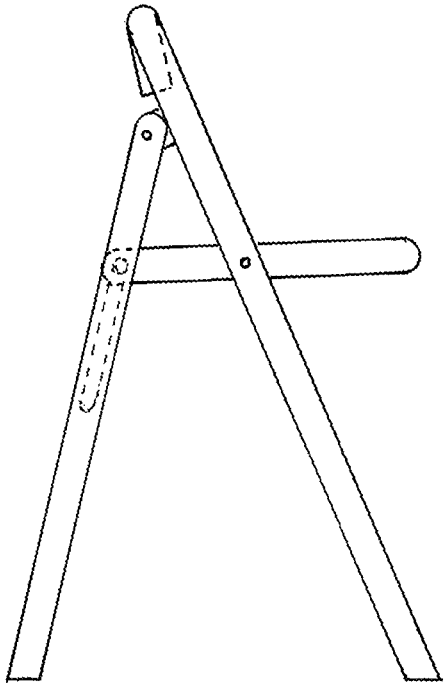
FIG. 4 is a side elevation of a conventional MPFC in its expanded state using a Type A system
Figure 5:
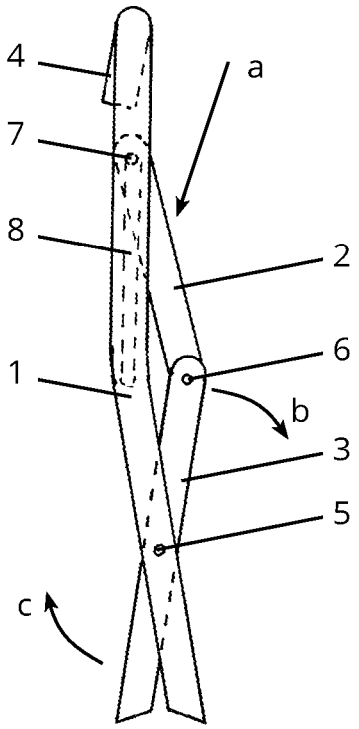
FIG. 5 is a side elevation of a conventional MPFC in its collapsed state using a Type X system.
Figure 6:
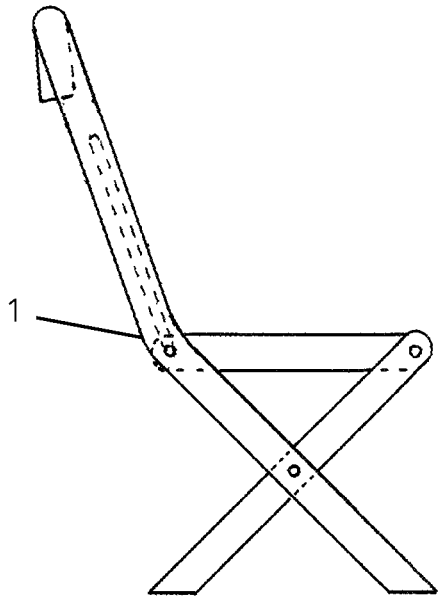
FIG. 6 is a side elevation of a conventional MPFC in its expanded state using a Type X system.
Figure 7:
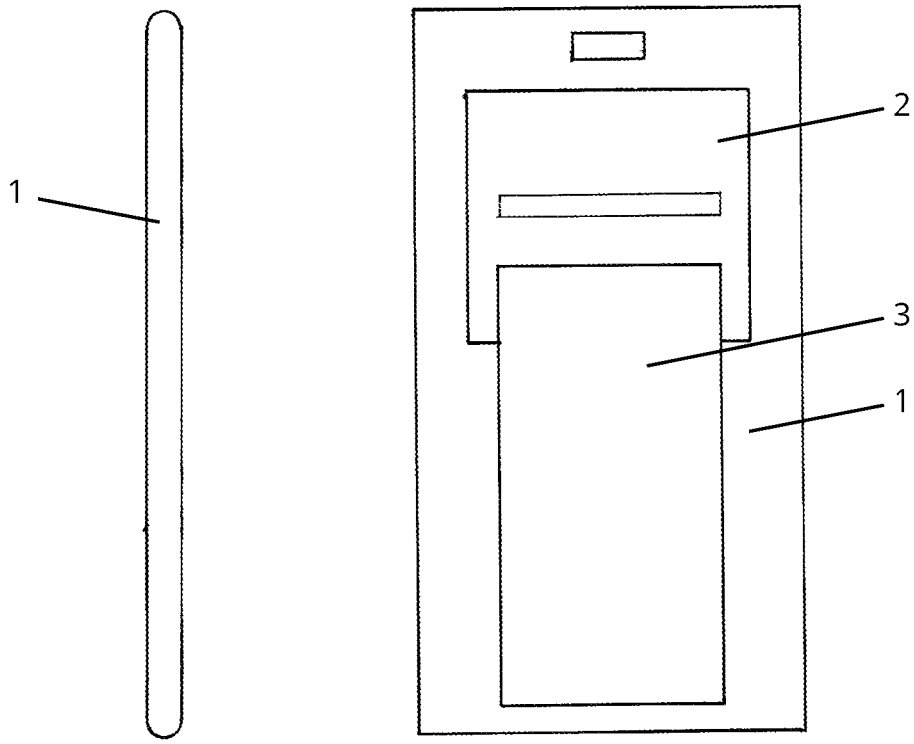
FIG. 7 shows side and front elevations of a UPFC of the prior art.
Figure 8:
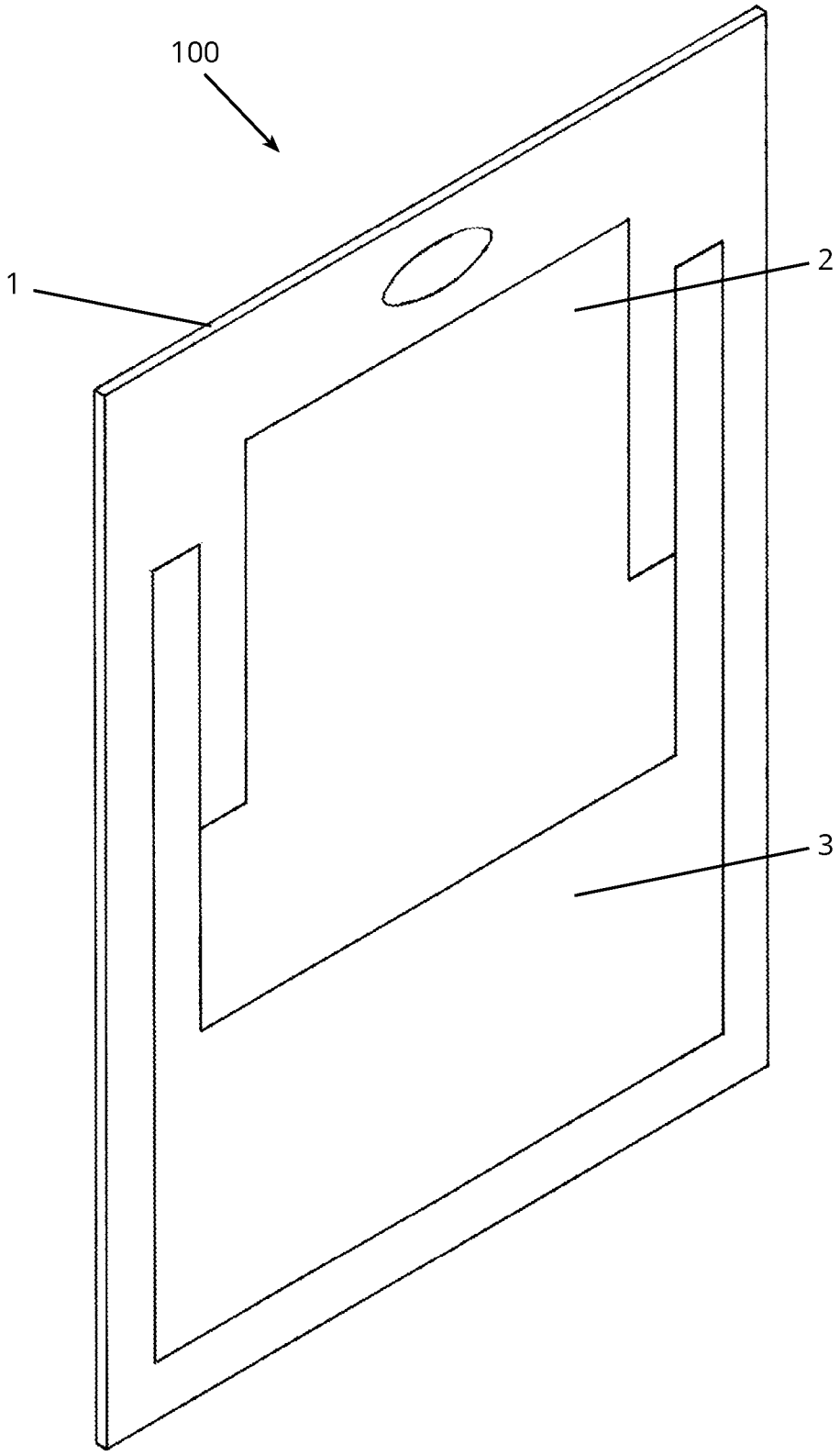
FIG. 8 is a perspective view of a chair according to a first embodiment of the present invention in a folded state.

In more detail, the chair 100 is made from a single sheet of stiff material and comprises three interlocking main parts as seen in the perspective view of the chair 100 in its collapsed form in FIG. 8. The main parts are the mainframe 1, the seat 2 and the back leg support 3. Although a single line is used in FIG. 8 to distinguish the separate parts, in reality there is a small gap, around 1 mm, between the parts.

Figure 9:
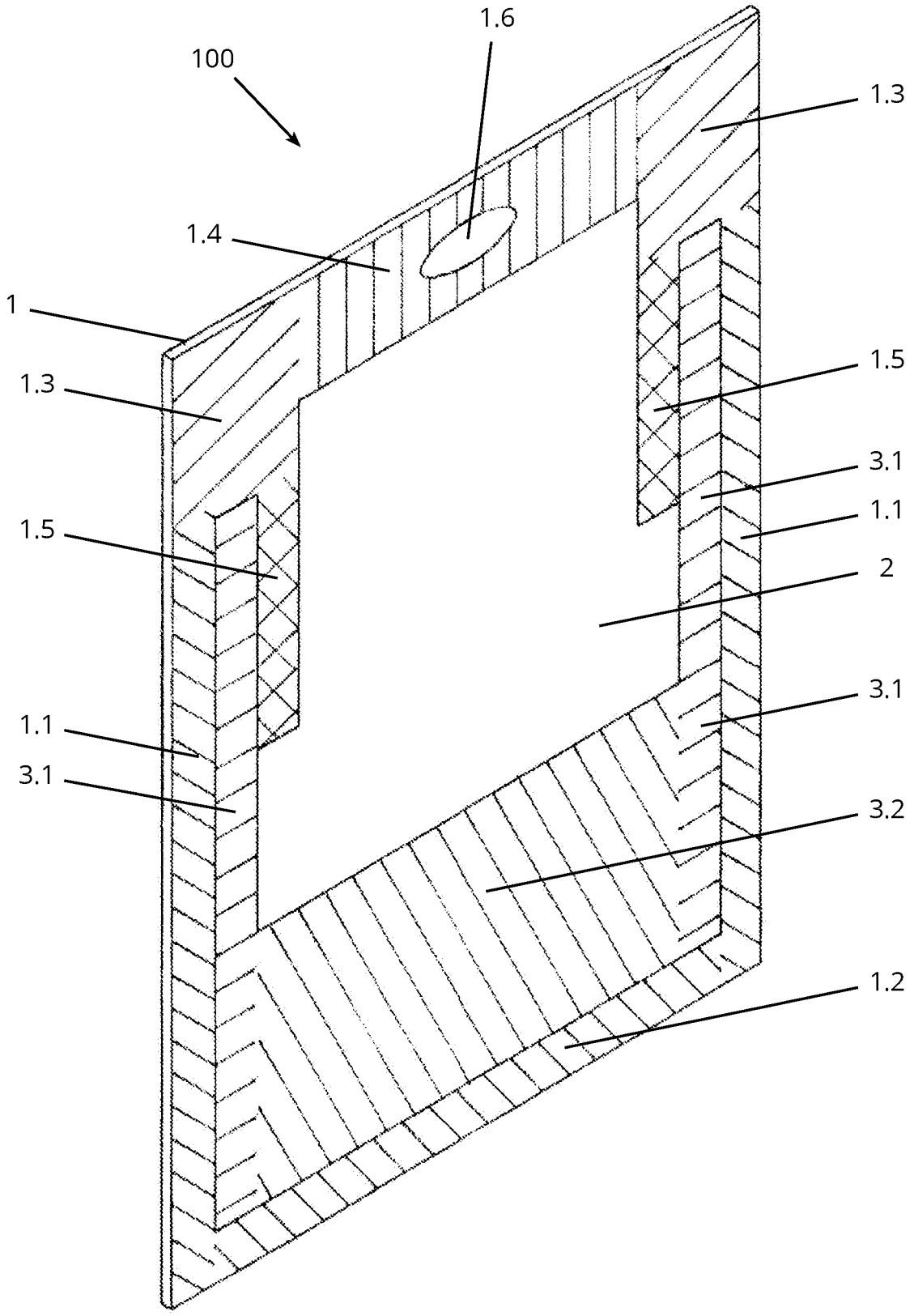
FIG. 9 is a perspective view of a chair of the first embodiment in a folded state showing different areas of main components.

FIG. 9 shows a perspective view of the chair 100 in its collapsed state, and indicates the various areas making up the mainframe 1. Although this component is cut out from one sheet of material, the various conceptual areas have specific functions, two of which (the seat supports 1.5) are especially important to the design. The separate areas are indicated using hatching.

The mainframe 1 comprises a backrest area 1.4 at the top of the folded chair 100, upper connecting areas 1.3 on either side of the backrest area 1.4, front legs 1.1 extending downwards from opposite sides of the respective upper connecting areas 1.3, and a front leg connecting area 1.2 extending between the bottoms of the respective front legs 1.1. In addition, seat supports 1.5 extend down from the upper connecting areas 1.3 parallel to and part way along the respective front legs 1.1. The seat supports 1.5 are disposed inwards of the front legs 1.1. These areas are all integrated into one, seamless component. The handle-hole 1.6 is optional, but useful for handling and carrying the chair 100 and hanging the chair 100 when stored.

The front leg connecting area 1.2 has two functions: it stops any outward splaying of the front legs 1.1 making the chair 100 more sturdy, and improves the overall comfort of the chair 100 as the chair 100 is tilted slightly backwards when in its expanded state.

The upper connecting areas 1.3 connect the front legs 1.1 to the backrest 1.4 and the seat supports 1.5.

In conventional Type A and Type X folding systems, parts corresponding to the seat supports 1.5 of the embodiment normally extend to become the front legs on chairs. However, in the embodiment of the invention, the seat supports 1.5 are truncated and do not form legs and instead are provided separately to the front legs 1.1. In the present embodiment, the seat supports 1.5 are truncated at just below the middle of the seat 2. This allows the seat 2 to be supported near its centre and allows for the chair 100 to be opened either way.

The mainframe 1 forms a closed shape with the back leg support 3 and the seat 2 nestled within it.

The back leg support 3 can be divided into three areas as shown in FIG. 9: two back legs 3.1 and a back leg connecting area 3.2, which together form a U-shape. In the collapsed state, the back legs 3.1 extend along the inside of the front legs 1.1, and the end of each back leg 3.1 is disposed between a corresponding front leg 1.1 and seat support 1.5.

The seat 2, as shown in FIG. 9, is shaped to accommodate the seat supports 1.5 when the chair is in the collapsed state, and to swing adjacent to the back legs 3.1. Thus, it has a T-shape with the cross of the T extending along the back leg connecting area 3.2, each arm of the T disposed between the end of a corresponding seat support 1.5 and the back leg connecting area 3.2, and the main body of the T disposed between the seat supports 1.5.

Figure 10:
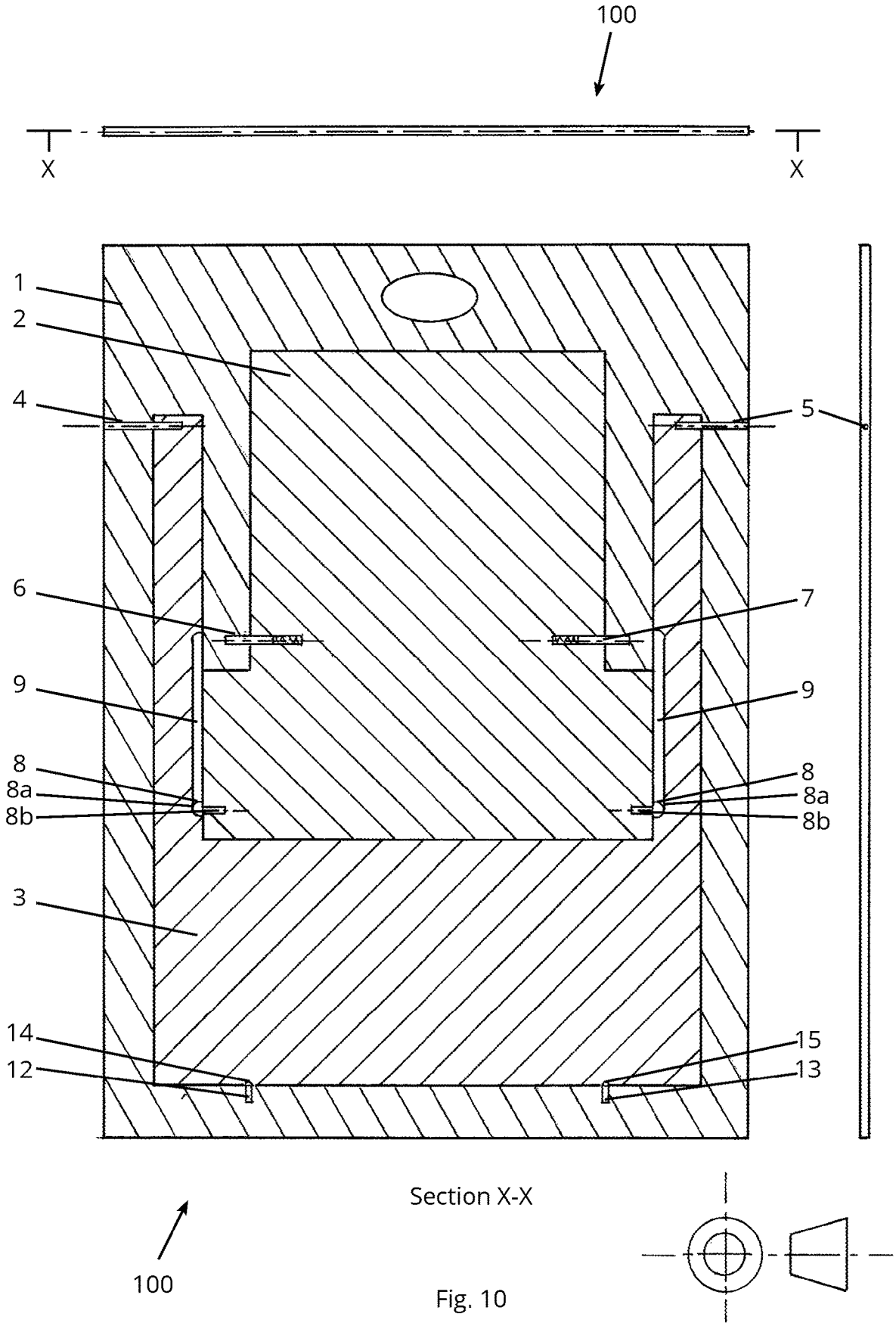
FIG. 10 shows a top view, a side view and a sectional view of a chair of the first embodiment.

FIG. 10 shows a top view, a side view and a cross-section of the chair 100 in its collapsed state. The three main parts (mainframe 1, seat 2 and back leg support 3) are connected using just two types of fixtures: rods within holes (giving pivot points) and rods moving within slots, allowing for the synchronised movement of the seat 2 with the back leg support 3.

The positions of the rods and slides, which allow the chair 100 to function as intended, are shown in the cross-section. The mainframe 1 is connected to the back leg support 3 by using two rods 4 and 5. These rods allow for the back leg support 3 to swing in either direction against the mainframe 1.

The seat 2 is connected to the mainframe 1 (more specifically, the seat support areas 1.5) by two spring-loaded rods 6, 7, which allow the seat 2 to swivel in either direction against the mainframe 1. Each spring-loaded rod 6, 7 is disposed at an upper end of, and passes between, the bottom of a respective seat support 1.5 and just below the midpoint of the seat 2/slightly above the cross of the T of the seat 2. Spring loaded rods 6, 7 are preferred instead of simple rods, as spring loaded rods 6, 7 allow for the assembly of the seat 2 to the mainframe 1 without drilling into the outer edge of the seat supports 1.5.

Figure 11:
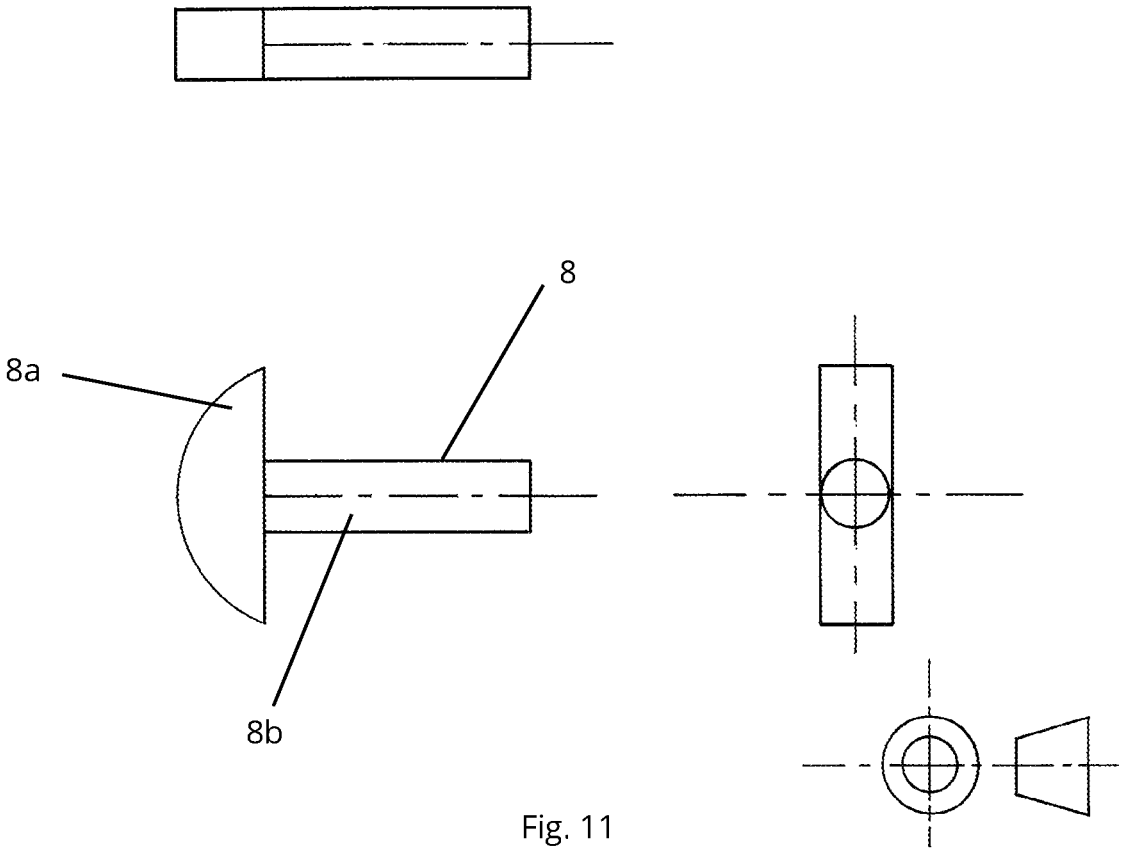
FIG. 11 shows top, front and side elevations of a slide component used in a chair of the first embodiment.
Figure 12:
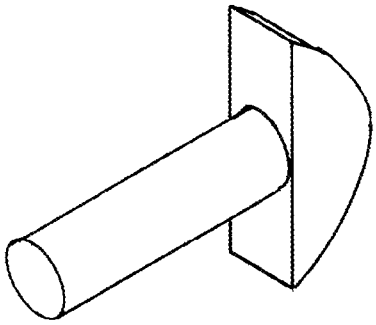
FIG. 12 is a perspective view of the slide component.

The seat 2 is also connected to the back leg support 3 (more specifically, slightly below the mid-way point of each back leg 3.1), using two slide components 8. FIG. 11 shows top, front and side elevations of slide components 8. The slide components comprise a slide component head 8*a* and a slide component shaft 8*b*. FIG. 12 shows a perspective view of the slide components 8. The slide component shafts 8*b* fit into a hole in the side of the seat 2 which allows the slide components 8 to rotate within the seat 2. The slide component heads 8*a* are curved with flat sides and extend outwards from the seat 2 into two slots 9 found within the back leg support 3 (specifically the back leg areas 3.1).

Simple rods could be used in place of the slide components 8. However, due to the slide component heads 8*a*, the slide components 8 have the advantage of spreading the load to the walls of slots 9 over the flat area of the slide component heads 8*a*. This minimises wear to the slots and minimises the risk of the thin walls of the slot 9 deforming under load. The curved profile of the slide component heads 8*a* allows the seat 2 and the slide components 8 to be fitted into the back leg support 3 without the need for surface machining and plates. This is done by placing the seat 2, with the slide components already fitted into the seat 2 at an angle to the back leg support 3 and then twisting the seat 2 into the correct position.

The slots 9 allow the slide components 8 to move freely along the back legs 3.1. The movement of the slide components 8 is limited to the length of the slots 9. To keep the main parts 1, 2, 3 from moving unintentionally against each other (causing the chair 100 to open accidentally), at least one magnetic component, comprising of an opposing pair of magnets, can be fitted between any of the adjacently disposed components in positions. For example, at least one magnetic component may be provided between the front edge of the seat 2 and the back rest 1.4, or between the back leg 3.1 and the front leg 1.1, or between the seat 2 and the seat supports 1.5, or between the seat supports 1.5 and the back leg 3.1. In some embodiments, two magnetic components are provided preferably comprised of first magnetic components 12, 13 fitted into the mainframe 1 (specifically the front leg connecting area 1.2 in FIG. 9) with corresponding second magnetic components 14, 15 made in the back leg support 3. Instead of using magnets, it is possible to use spring-loaded ball components to hold the chair in the closed position.

Finally, the mainframe 1 is connected to the back leg support 3 by two simple rods 4, 5, which allow the back leg support 3 to swivel in either direction against the mainframe 1. Each rod 4, 5 is disposed at an upper end of, and passes between, the top of a respective front leg 1.1 and the top of a corresponding back leg 3.1. In particular, the rods 4, 5 mate with a corresponding hole at the top portion of the front legs 1.1 through a push fit mechanism into the hole at the top portion of the front legs 1.1 from the outer edge of the front leg 1.1, through the hole in the back leg 3.1 and into a corresponding blind hole in the seat supports 1.5. The hole in the front legs 1.1 and the blind hole in the seat supports 1.5 may be formed by drilling. As shown in FIG. 10, the rods 4, 5 extend through the top of each corresponding back leg 3.1, so that each rod 4, 5 has an end disposed in a corresponding seat support 1.5 and an opposing end extending to the outer edge of a corresponding front leg 1.1 so as to be flush with the outer edge.

Having the rods 4, 5 extend all the way through the back legs 3.1 allows for less wear on the rods 4, 5 and reduces any bending or deforming under load that the rods 4, 5 may experience which would otherwise cause the upper edge of the back legs 3.1 to touch the areas 1.3 in the mainframe 1 when under load. In an embodiment in which the chair 100 is formed from aluminium, the rods 4, 5 are push fitted from the outer edge of the front leg 1.1, through the front leg 1.1 and the back leg 3.1, and into a blind hole in the seat supports 1.5. Such a configuration provides a sufficiently tight fit between the chair 100 and the rods 4, 5 so as to allow friction to hold the rods 4, 5 in position relative to the front and back legs 1.1, 3.1. The hole in the back leg 3.1 may have a marginally larger diameter than the hole in the front leg 1.1 to allow the back leg support 3 to swing freely against the mainframe 1.

Figure 13:
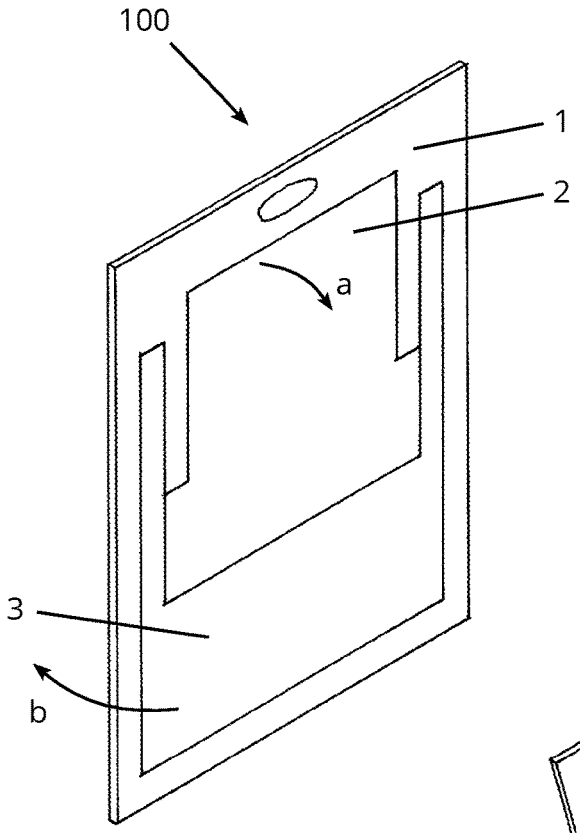
FIG. 13 is a further perspective view of the chair of the first embodiment in a folded state.

As shown in FIG. 13, to open the chair 100 from the collapsed or folded position, the user simply pushes the seat 2 out of the plane of the chair 100. The rotational movement of the seat 2 around the spring-loaded rods 6, 7 against the mainframe 1 causes the slide components 8 to push against the walls of the slots 9 in the back legs 3.1 and also causes them to move upwards within the slots 9. This in turn causes the back leg support 3 simultaneously to pivot about rods 4, 5 and swing away from the mainframe 1 in the opposite direction to the swing of the seat 2, thus expanding the chair. Moving the seat 2 to its original position simultaneously causes the back leg support 3 to move to its original position, to collapse or fold the chair 100.

Due to the configuration of the three main parts and in particular, the use of the seat supports 1.5, the chair 100 may be opened in either direction.

Figure 14:
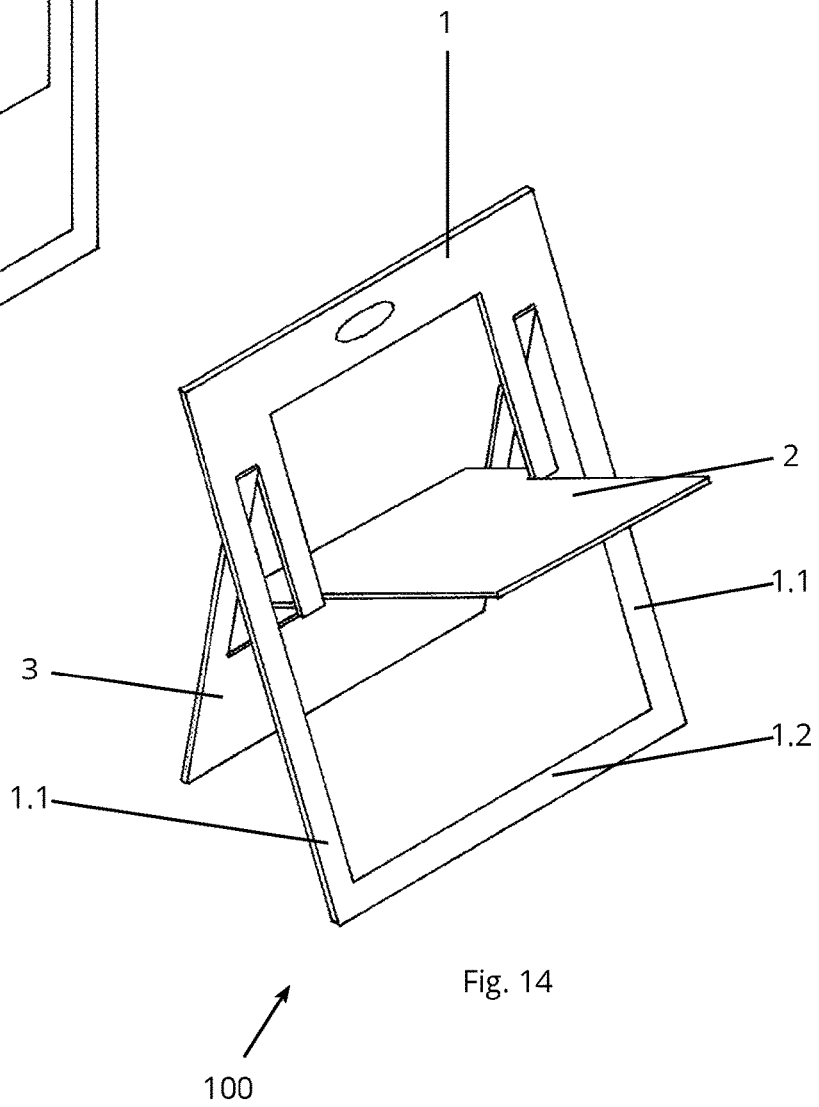
FIG. 14 is a perspective view of the chair of the first embodiment in an expanded state.

As noted above, FIG. 13 shows a view of the chair 100 in its collapsed state. To expand the chair 100, one simply pushes against the top area of the seat 2 in either direction (in the example, the seat is pushed forwards, from behind the chair 100, as shown by arrow a in FIG. 13). This causes the magnetic components 12, 13 to disengage, allowing the back leg support 3 to swing in the opposite direction simultaneously, shown by arrow b. The seat is pushed until it reaches its limit (governed by the length of the slots 9, thus expanding the chair 100, as shown in FIG. 14.

To collapse the chair 100, one simply raises the seat 2 to its original position, which in turn causes the back leg support 3 to move simultaneously to its original position within the mainframe 1. The attraction of the first magnetic components 12, 13 to their corresponding second magnetic components 14, 15 ensures the chair 100 does not open unintentionally.

The chair 100 has a number of advantageous features, including those set out below:

a. The main parts of the chair 100 are made from a single sheet of material, which provides an improved aesthetic and reduces manufacturing costs.
b. The chair 100 is entirely flat when folded, thereby allowing chairs to be stored and/or stacked with maximum efficiency.
c. The main parts are tessellated and fit precisely together on one plane (when the chair 100 is in its collapsed state). This is aesthetically pleasing and further allows for an image to be printed on the entirety of both sides of the chair 100, with minimal loss of the image (only parts of the image in between the main parts will be lost as there is a gap of about one millimetre between them).
d. The chair 100 uses a Type A folding system but has only single component thickness (a UPFC). This has the advantage of allowing the mainframe to be straight, thus keeping the chair's thickness to a minimum when in its collapsed state, whilst ensuring a comfortable backrest that is not too far back.
e. The chair 100 does not necessarily require a swivelling backrest.
f. By using a Type A system within a UPFC, the chair 100 overcomes the inconvenience of needing to manoeuvre any main component in more than one direction in order to expand and collapse the chair 100 (such as locating a main part into a groove or hole found in another main part).
g. The chair 100 is sturdy, despite being a UFPC.
h. The design of the chair 100 allows it to be extremely thin relative to other UPFCs.

Preferably, the overall thickness of all the chair 100 is just 8 mm over its entirety, whereas prior art UFPCs have a thickness of over 15 mm.

i. The chair 100 expands in both directions, so it can be held either way (without the need to twist it the "right way" in order to expand it).
j. The chair 100 expands in both directions, allowing both sides of the chair 100 to be treated similarly and have two differing (or identical) images printed on each side. Since the chair 100 expands in either direction, the user may choose which image they would like to be visible from the back or the front when the chair 100 is expanded.

k. Assuming the chair 100 has different printed images on each side, the user may choose which image faces outwards, when the chair 100 is being hung.

l. The chair 100 appears to be free of connecting components as these are found within the mainframe 1, seat 2 and back leg support 3. There are no visible smaller components such as hinges, rods, brackets etc.

The chair 100 also has a number of manufacturing advantages, as follows:

m. The main parts may be cut from one sheet of material in one procedure, with minimal waste of material. Any suitable cutting method may be used. For example, if the chair 100 is made from a single sheet of metal, the parts may be cut using a laser.

n. The chair 100 requires a minimum of connecting components, namely only rods 4-7 within holes and slide components 8 inside slots 9.

o. Each main part requires a minimum of further machining, i.e. the machining of holes for rods and the machining of the slides.

p. The main parts can be assembled without any machining to the surfaces of the main components or the need for cover plates.

Features of the chair 100 include the following:

A. the configuration and shape of the three main components

B. the use of the seat supports which do not extend to become front legs as in other chairs but serve solely to support the middle of the seat C. the creation of the front legs by extending the back of the chair 100 outwards, beyond the width of the back leg support and allowing the front legs to run on the outside of the back leg support D. the use and manipulation of the type A folding scheme within a totally flat surface E. in the chair's collapsed state, the main parts fit perfectly together (no gaps, apart from the gap created during the machining of the original sheet material) to give a virtually uninterrupted, perfectly smooth front and back surface F. through the material used (for example, precision ground aerospace grade aluminium), the configuration of main parts and type of mechanism employed, the chair 100 measures 8 mm in thickness at every point, in its collapsed state. This has the obvious advantage that one may fit more of these chairs in a given space than other chairs mentioned G. the chair 100 may be opened either way; there is no front or back H. the main parts are made entirely from one sheet of material I. it uses minimal main components J. it uses minimal mechanical connections K. is operated by one single movement of one main part, in just one direction L. the seat and the back leg support move simultaneously when expanding and collapsing the chair 100

M. the chair 100 may have printed images across all main surfaces

N. the images will be virtually unbroken or spoilt by any gaps in the surfaces (apart from the one millimetre gap created in the cutting process of the main components, which is necessary to allow the main parts to move freely)

Figure 15A:
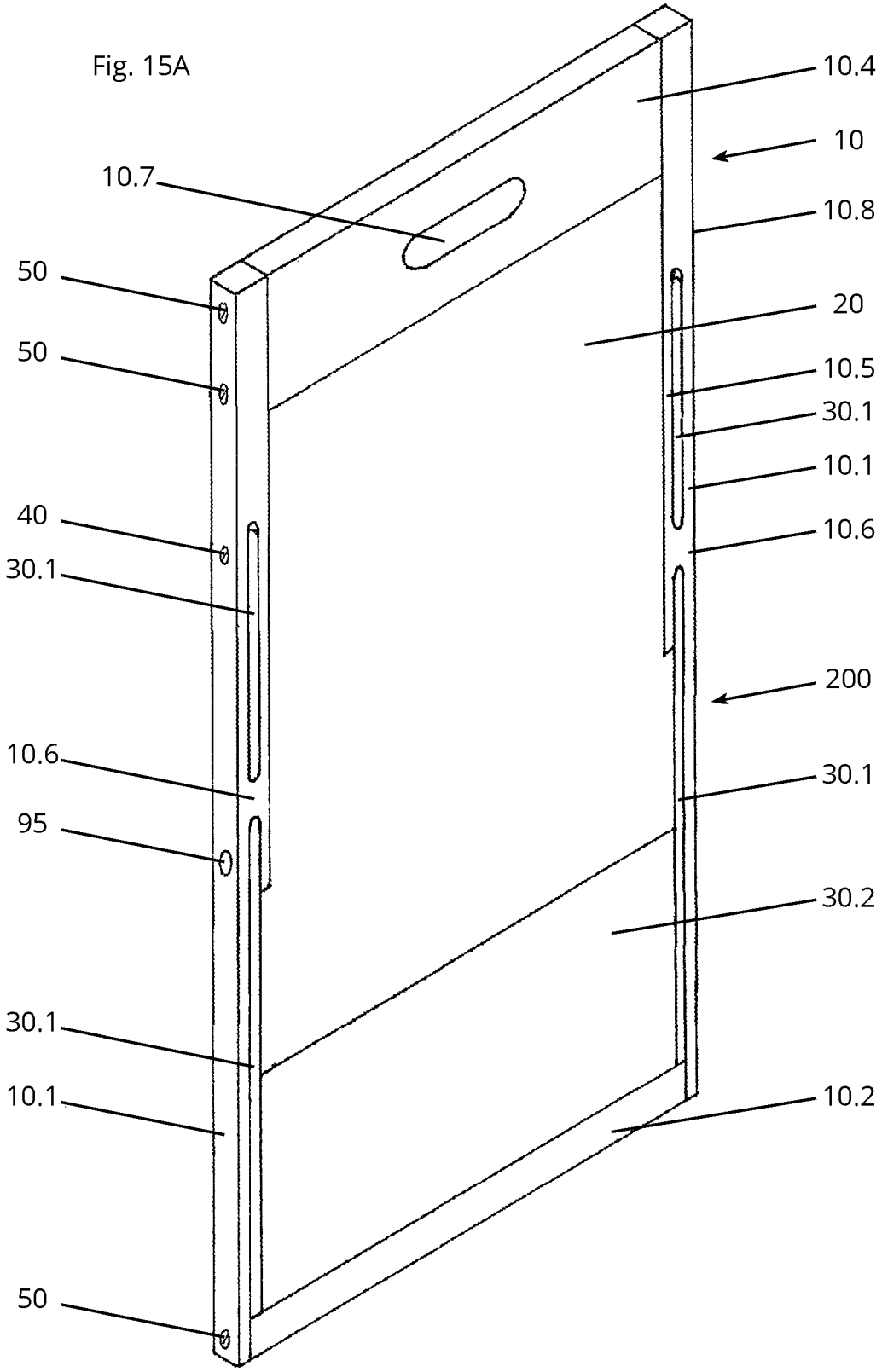
FIGS. 15A and B respectively show the front and back sides of a chair according to a second embodiment of the invention.
Figure 15B:
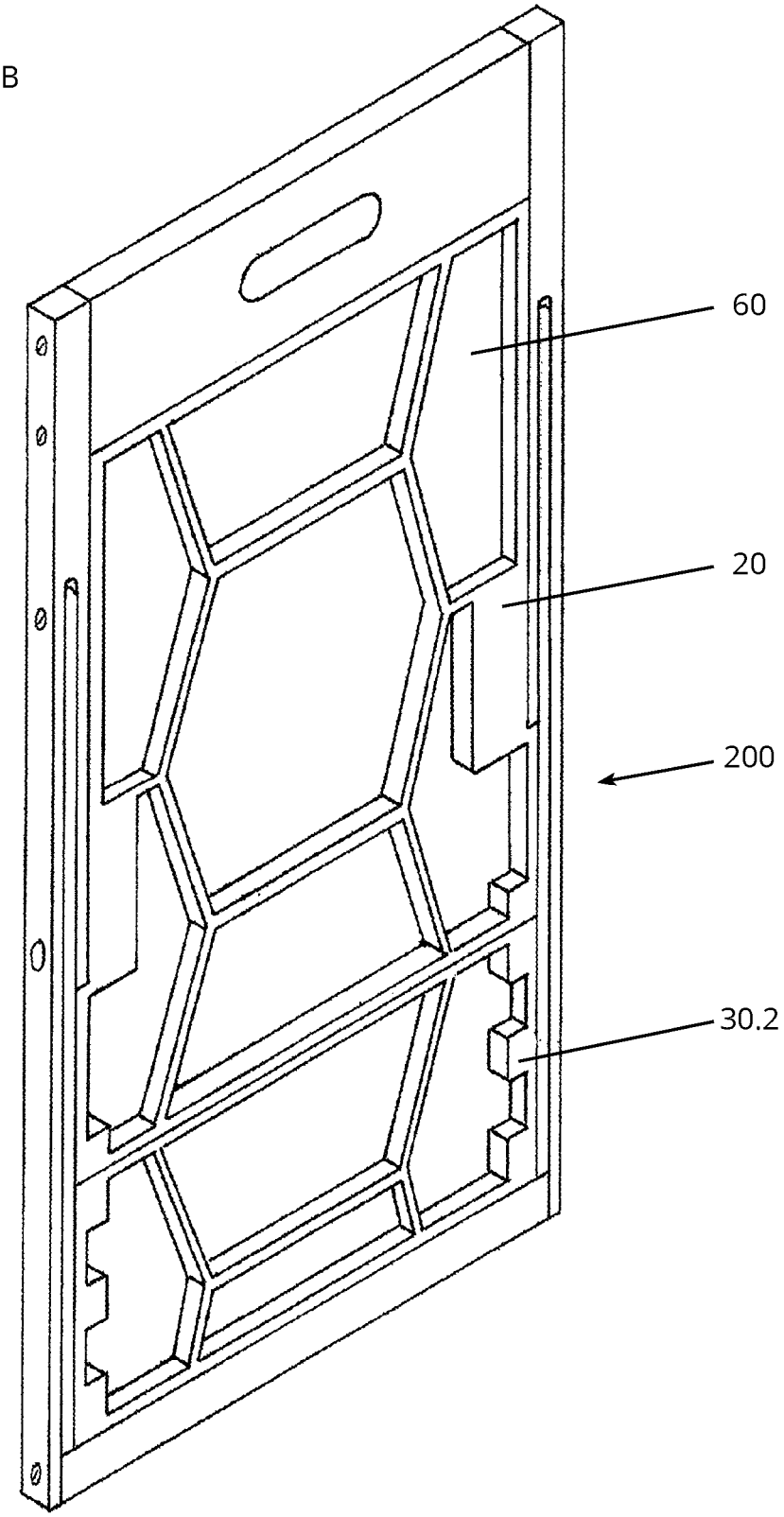
Figure 16:
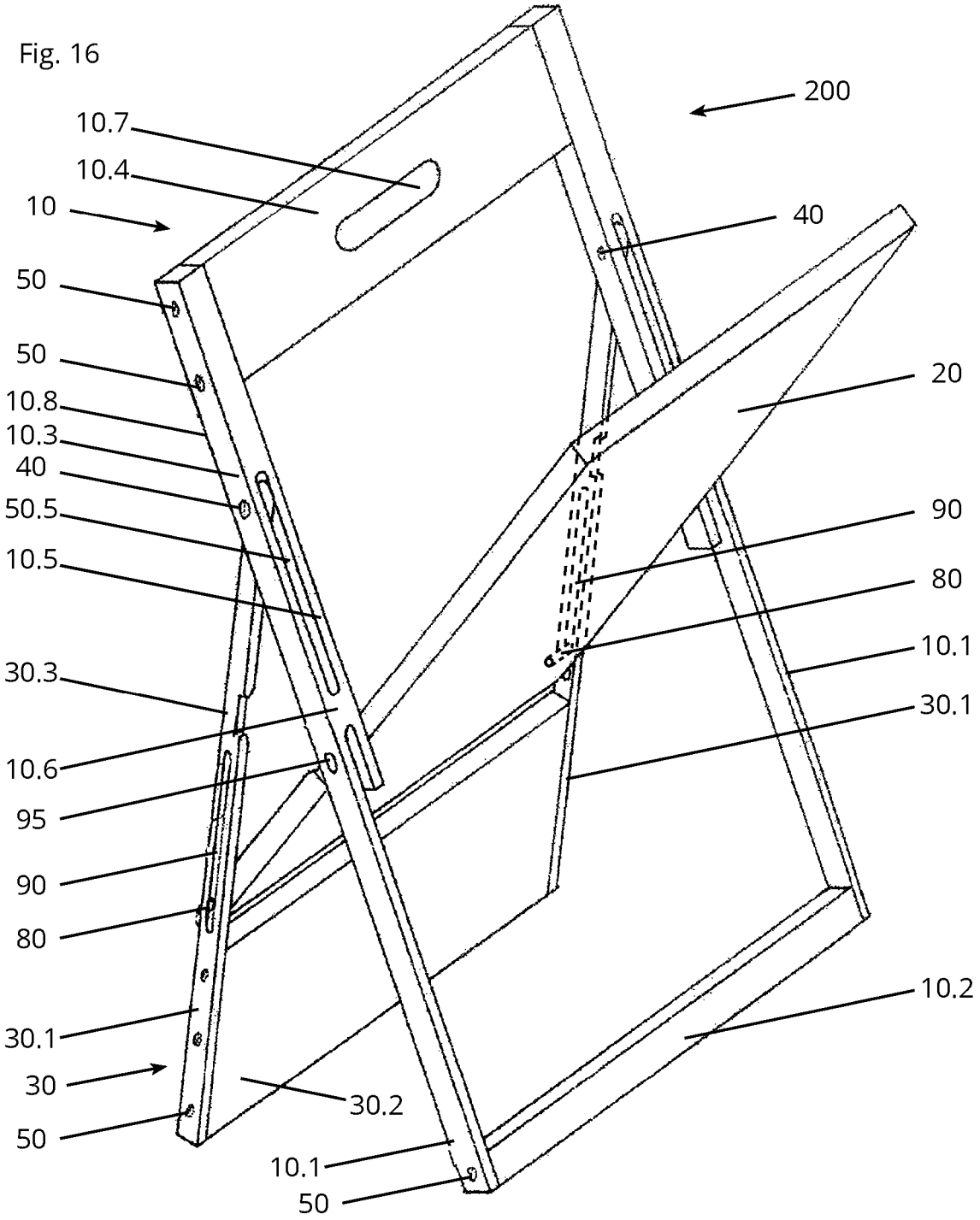
FIG. 16 shows a perspective view of the chair of the second embodiment in a partially collapsed state.

A second embodiment of a chair 200 according to the present invention is shown in FIGS. 15 and 16. In particular, FIGS. 15A and B respectively show the back and front sides of the chair 200 and FIG. 16 shows a perspective view of the chair partially collapsed. In common with the first embodiment, the chair 200 of the second embodiment includes a mainframe 10, a seat 20 and a back leg support 30. However, in this case these components are not all formed of a single sheet of material and indeed the mainframe 10 and the back leg support 30 are formed of multiple components fitted together.

In more detail, the mainframe 10 comprises a backrest 10.4 with a hole 10.7 in it, two separately formed side pieces 10.8 and a separately formed front leg connecting component area 10.2. These are all connected together using screws 50 to form the mainframe 10 (although again it would be possible to use a single sheet, or to use a different connecting mechanism). The side pieces 10.8 are formed of a single piece of material and each comprises a front leg 10.1 and a seat support 10.5 integrally formed with an upper connecting area 10.3. The s eat supports 10.5 [M OU1]again extend part way down and in parallel with the front legs 10.1. To strengthen the design, an optional reinforcing area 10.6 is formed between the lower end of each seat support 10.5 and the corresponding front leg 10.1. The reinforcing area 10.6 is not as deep as either the front leg 10.1 or the seat support 10.5. A hole 95 is provided in the front leg 10.1, just below the reinforcing area 10.6, to allow a rod/bolt (not shown) to be inserted/screwed in order to connect the seat 20 to the seat support 10.5 and allow the seat 20 to pivot against seat supports 10.5.

The back leg support 30 is formed of two back legs 30.1 and a back leg connecting component 30.2, which are all separately formed and joined together by screws 50 or any other suitable mechanism (such as adhesive). Again, it would be possible to use a single sheet to integrally form the back leg support 30. Each back leg 30.1 is provided with a groove 90, which extends all the way through the width of the back leg 30.1. Slide components 80 mounted to each side of the back of the seat 20 allow the back of the seat 20 to slide relative to the corresponding back legs 30.1. Each back leg 30.1 also includes a thinner portion 30.3 including a notch at the front in the depth direction, which fits around the reinforcing area 10.6 when the chair 200 is collapsed.

The top of each back leg 30.1 fits within the gap between the corresponding front leg 10.1 and seat support 10.5 when the chair 200 is collapsed, and is connected to both the corresponding front leg 10.1 and seat support 10.5 by means of a tight fitting rod 40 (or bolt) in the same manner as the chair 100 of the first embodiment. Given the relatively narrow width of the seat supports 10.5 in this embodiment, the hole which accommodates rod/bolt 40 extends through the seat supports to allow for a more secure connection between the front leg 10.1 and the back leg 30.1.

As shown in FIGS. 15A and B, when the chair 200 is collapsed, the seat 20 and the back leg support 30 are nested within the plane of the mainframe 10, and, where the optional reinforcing area 10.6 is not provided, the chair is a rigid, tessellated uni-plane folding chair (UPFC). Where provided, the reinforcing area/connecting piece 10.6 overlaps the thinner portion 30.3 of the back leg 30.1. However, the area of overlapping, when the collapsed chair 200 is viewed in plan (that is, facing the plane of the collapsed chair), is small. The chair 200 is one component in depth apart from the reinforcing piece 10.6. Moreover, the connecting piece 10.6 is nested within the plane of the collapsed chair, is flush with the other components on that side of the chair and does not protrude out of the plane of the chair.

It is preferred that where the reinforcing area 10.6 is provided, the area of overlapping components in plan view is 5% or less of the area of the chair, preferably 1% or less, more preferably 0.5% or less, and yet more preferably 0.1% or less. In general, however, it is preferred that the chair is a tessellated, uni-planar folding chair and there is no overlap—that is, the area of overlapping components in plan view is 0%.

In addition, the rear side of the chair 200 is a flat surface when the chair 200 is collapsed, with only minor clearance gaps between the main components. By contrast, the front surfaces of the back leg connecting component 30.2 and the seat 20 are scooped out in a honeycomb pattern 60 as shown in FIG. 15B, although this is optional (of course, other patterns/images could be used as a basis for this weight-reducing process). This removes excess material whilst still maintaining the required rigidity and strength of the chair 200. Accordingly, the front side of the chair 200 is not flat when collapsed, but all the components in the chair still fall within a single spatial plane or substantially fall within a single spatial plane. Thus, the chair 200 of the second embodiment enjoys many of the features and advantages discussed above in respect of the first embodiment.

Figure 17:
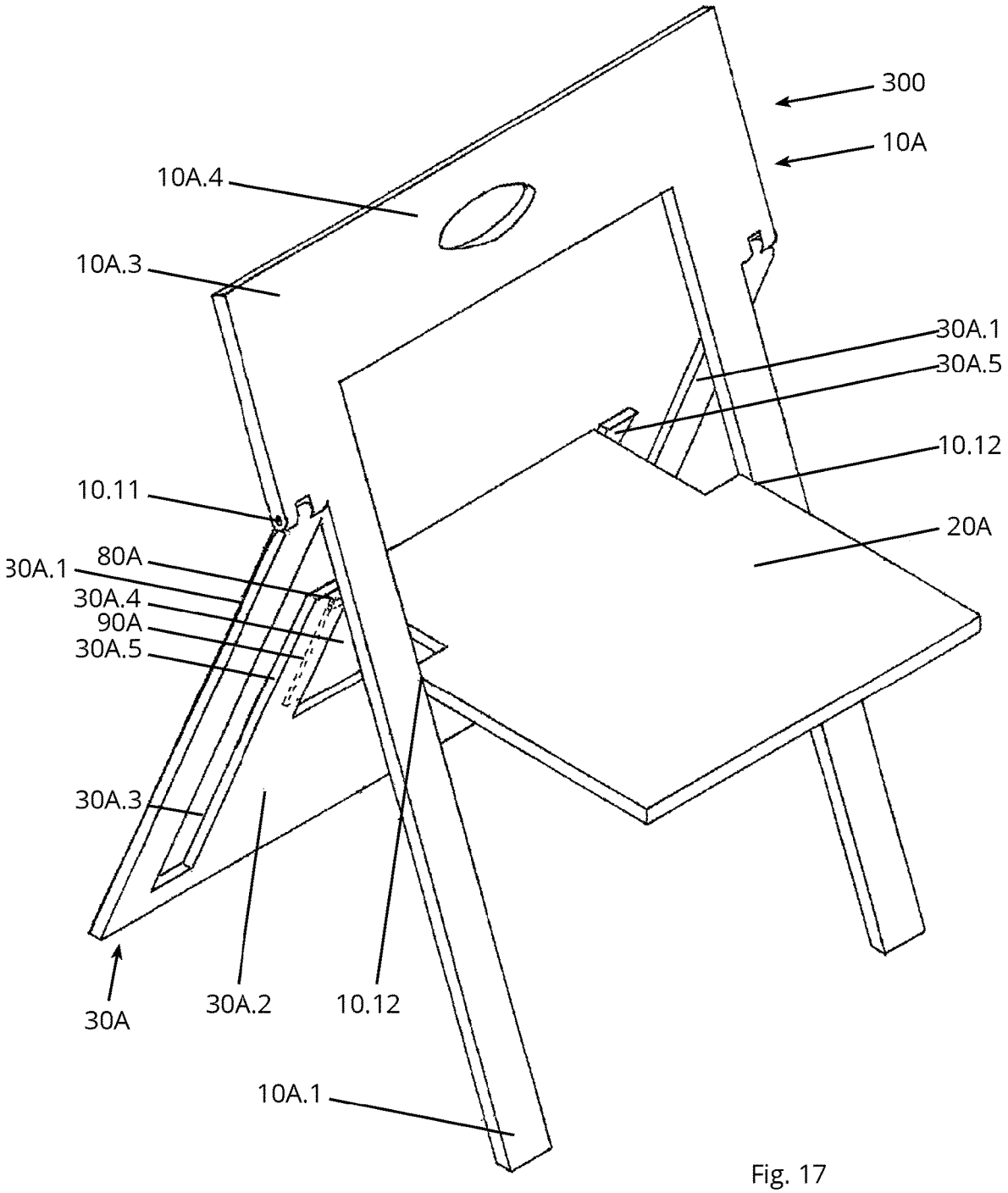
FIG. 17 is a perspective view of a chair of the third embodiment of the present invention in an expanded state.

FIG. 17 shows an expanded chair 300 of a third embodiment of the invention, which works on similar principles to the first and second embodiments and again includes a mainframe 10A, a seat 20A and a back leg support 30A. These components are all formed of a single sheet of material.

In more detail, the mainframe 10A comprises a backrest 10A.4 and two separately formed front legs 10A.1 extending down from an upper connecting area 10A.3. In this case, each front leg 10A.1 extends downwards from an inner portion (in the width direction of the chair) of the respective upper connecting area 10A.3.

The back leg support 30A is formed of two back legs 30A.1 and a back leg connecting area 30A.2, which are all formed of a single sheet. A leg-accommodating groove or cut-out 30A.3 is formed between the back leg connecting area 30A.2 and each back leg 30A.1. In addition, a U-shaped cut-out 30A.4 is formed at the top of the back leg connecting area 30A.2, thereby forming arms 30A.5. Each arm 30A.5 is provided with a slide 90A. A slide pin 80A mounted to the back of the seat 20A allows the back of the seat 20A to slide relative to the back leg support 30A. Pivot points are provided by the use of sprung loaded rods (similar to those used in chair 100) at points 10.12 which allows the seat 20A to pivot against the mainframe 10A.

The top of each back leg 30A.1 is hinged to the upper connecting area 10A.3 using a hinge. Preferably, the hinge is formed by the use of a rod 10.11, running through the upper connecting area 10A.3 and into the back leg 30A.1 and back into the upper connecting area 10A.3. Alternatively, a hinge may be provided on the outside (in the width direction of the chair) of the front leg 10A.1. When the chair 300 is collapsed, the front legs 10A.1 fit within the respective leg-accommodating groove cut-outs 30A.3 of the back leg support 30A, and the back of the seat 20A fits within the a U-shaped cut-out 30A.4.

When the chair 300 is collapsed, the components are all nested within one another and together form a single plane, and the chair is a rigid uni-plane folding chair (UFPC). In addition, both sides of the chair 300 form flat surfaces when the chair 300 is collapsed, with only minor clearance gaps between the main components. Thus, the chair 300 of the third embodiment enjoys many of the features and advantages discussed above in respect of the first embodiment.

A fourth embodiment of a chair 400 is shown in FIGS. 18-21. The chair 400 comprises components corresponding to the chair 100 of the first embodiment, including a mainframe 1B, a seat 2B and a back leg support 3B. The chair 400 of the fourth embodiment differs from the chair 100 of the first embodiment in that the chair 400 further comprises braces 401, 402 disposed between corresponding front legs 1B.1 and back legs 3B.1, so that each brace 401, 402 is provided adjacently to corresponding front and back legs 1B.1 and 3B.1.

The braces 401, 402 are elongate struts that provide further structural support between the back legs 3B.1 and the front legs 1B.1 in the expanded state, and the advantages of providing the braces 401, 402 will be discussed in more depth below.

Figure 18:
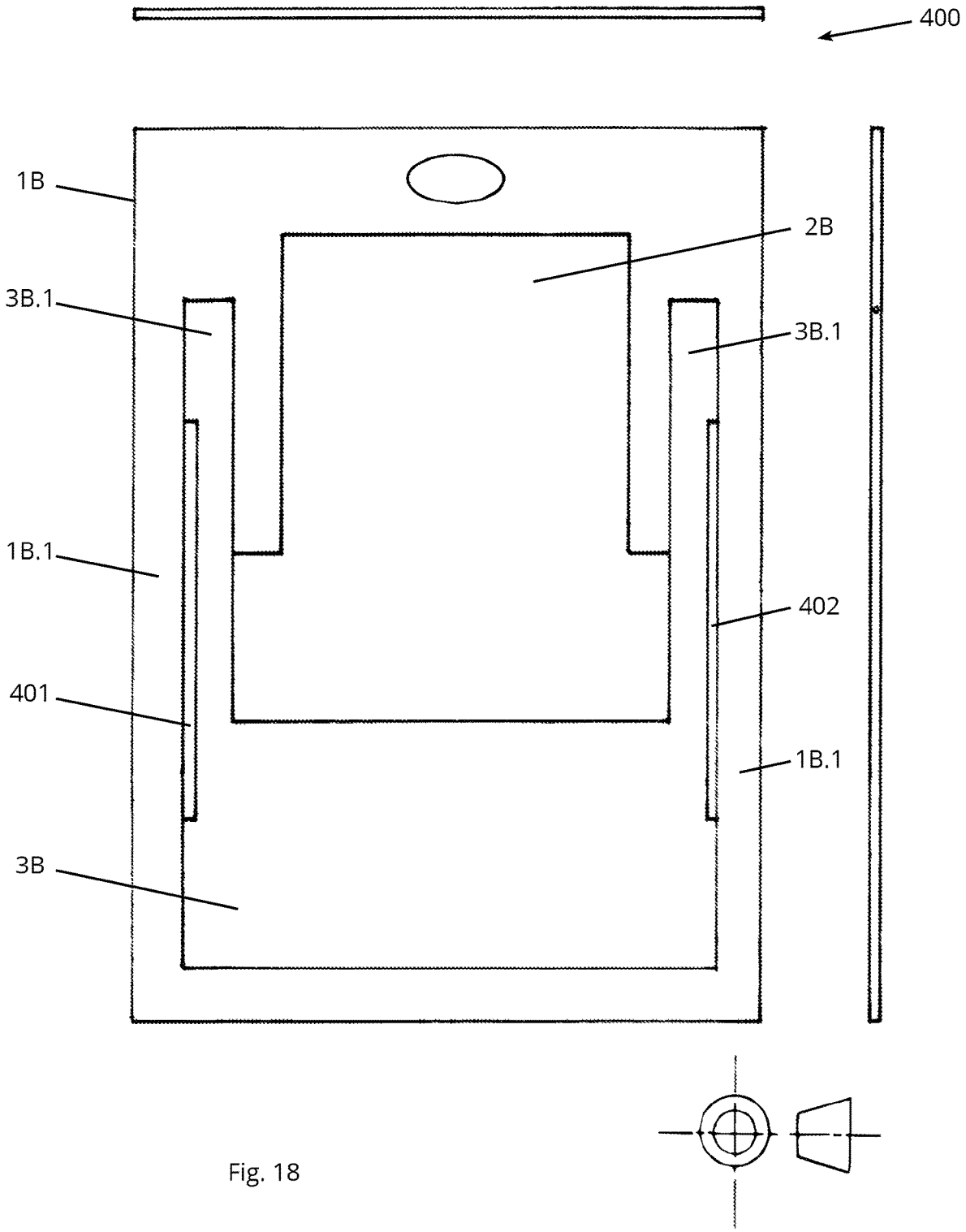
FIG. 18 shows front, side and plan elevations of a chair according to a fourth embodiment of the invention in a folded state.
Figures 19, 20:
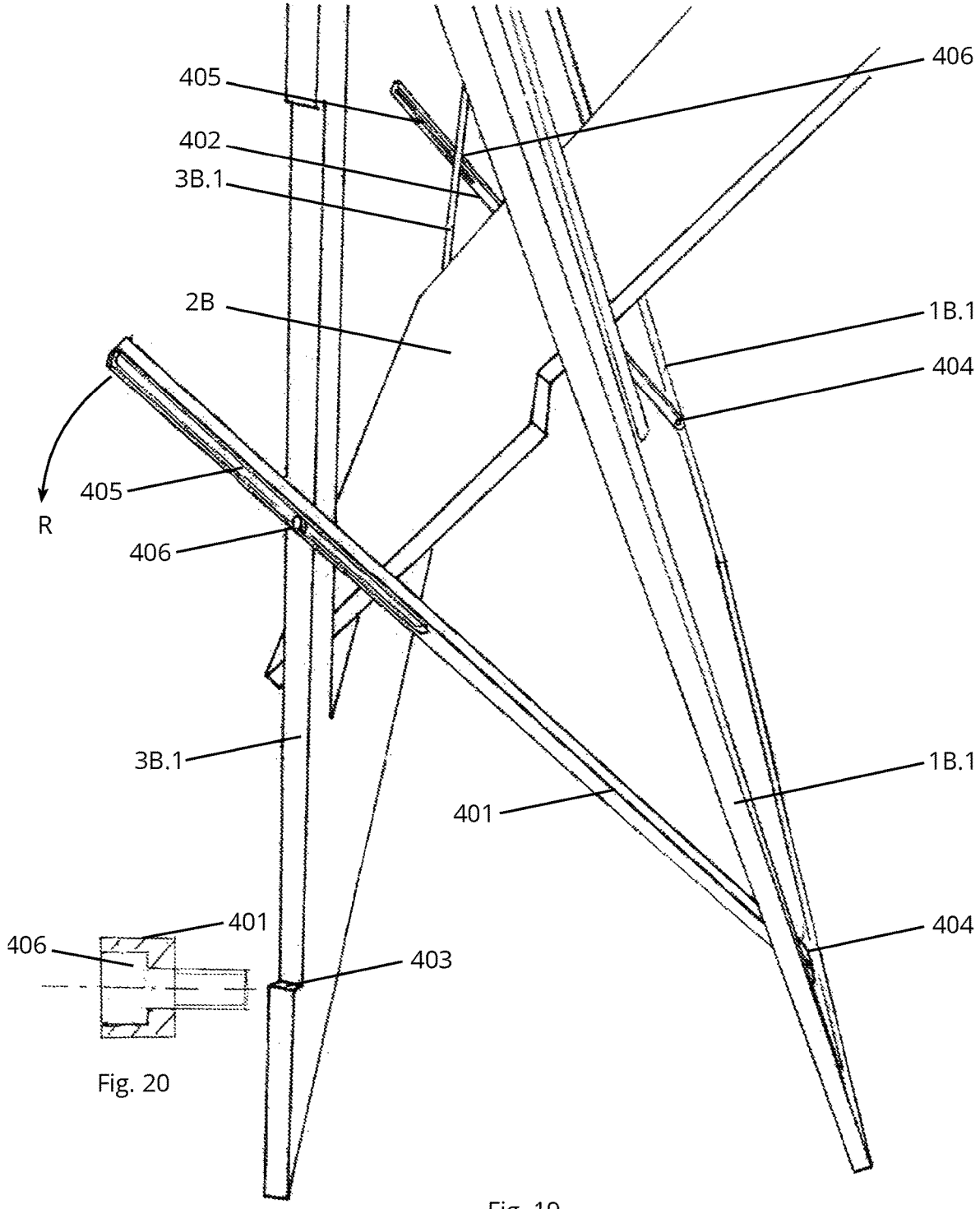
FIG. 19 is a perspective side view of the chair of the fourth embodiment of the present invention in an expanding state.
FIG. 20 is a cross-sectional view of a brace of the fourth embodiment of the present invention.
Figure 21:
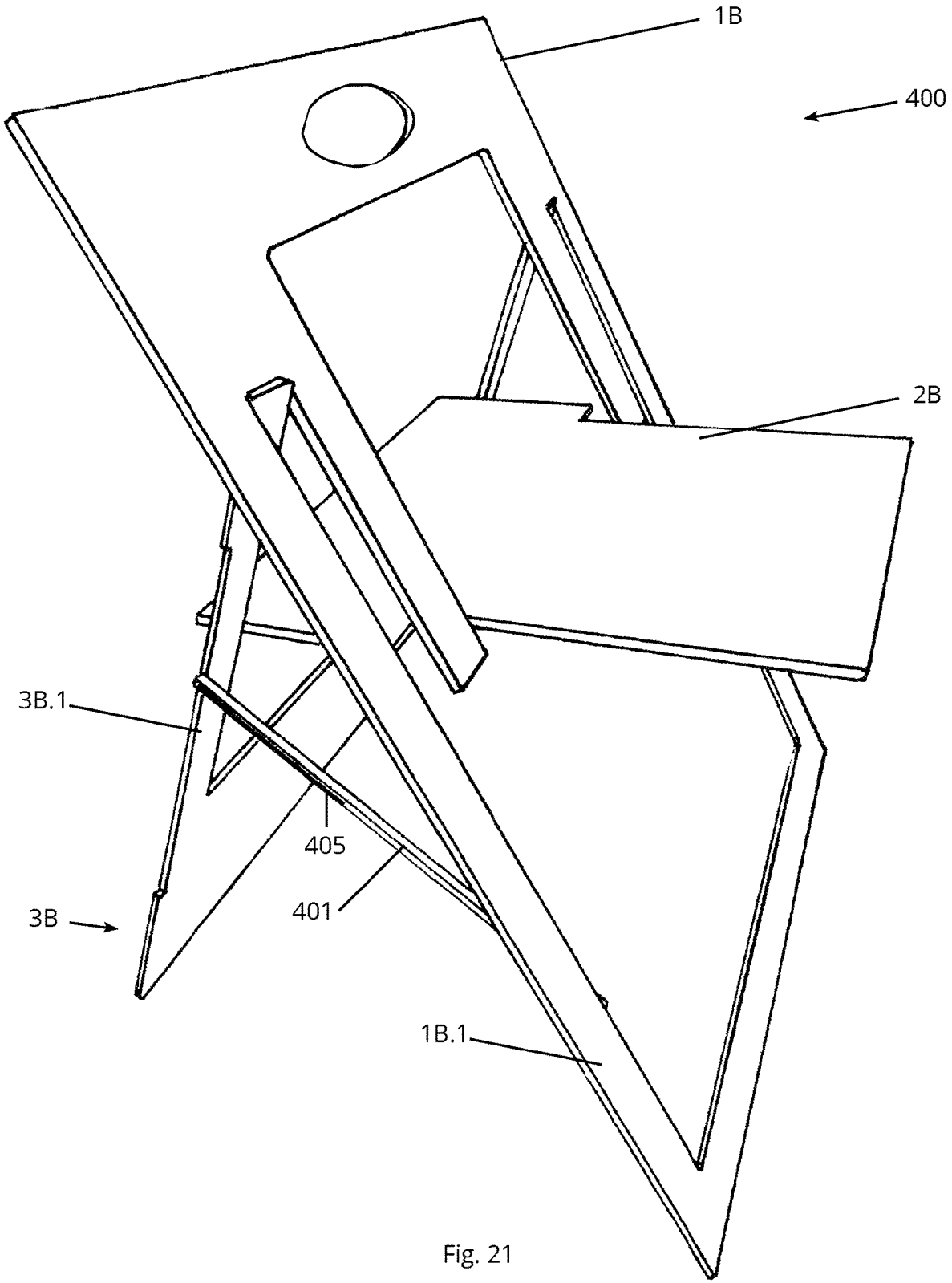
FIG. 21 is a perspective view of the chair of the fourth embodiment of the present invention in an expanded state.

Like other embodiments, the components of the chair 400 can all be formed of a single sheet of material. When the chair 400 is in the folded state as shown in FIG. 18, the braces 401, 402 are flush or coplanar with the mainframe 1B, the seat 2B and the back leg support 3B. In order to achieve this flush configuration, the back leg support 3B is configured to accommodate each brace 401, 402. So that the back leg support 3B can accommodate the braces 401, 402, the back leg support 3B of the fourth embodiment differs from that of the first embodiment by comprising a cutout portion 403 for each brace 401, 402. Specifically, the cutout portions 403 are disposed in the side of each back leg 3B.1 that abuts the corresponding front leg 1B.1, in which each cutout portion 403 has dimensions corresponding to each brace 401, 402, as shown in FIGS. 18, 19 and 21.

Each brace 401, 402 has an upper end and a lower end. The lower end of each brace 401, 402 is rotatably connected to a lower portion of a corresponding front leg 1B.1. Any connection may be used that is suitable for allowing the brace to rotate with respect to the main frame 1B in the backwards and forwards direction R. In this embodiment, the braces 401, 402 include an aperture 404 at the lower end for receiving a bolt that connects the lower end of each brace 401, 402 to a lower portion of the front legs 1B.1.

The upper end of each brace 401, 402 is rotatably and slidably connected to a corresponding back leg 3B.1. Any suitable connection may be used that allows the braces 401, 402 to rotate and slide relatively to the back leg 3B.1 in the backwards and forwards direction R. In this embodiment, the connection is provided as an elongate aperture 405 at the upper end of each brace 401, 402 that engages with the head of a bolt 406 disposed in each back leg 3B.1. Specifically, each bolt 406 is screwed to the side of the corresponding back leg 3B.1 that defines the cutout portion 403. The bolts 406 extend through the corresponding elongate aperture 405 with the head of each bolt 406 being flush with the side of the corresponding brace 401, 402. This is shown in the cross-sectional view of FIG. 20, which illustrates the bolt 406 extending through the elongate aperture 405 so that the head of the bolt 406 is flush with the side of the brace 401.

Each brace 401, 402 is therefore able to move relatively to the corresponding back leg 3B.1 as the elongate aperture 405 slidably engages with the bolt 406. In the folded state in FIG. 18, the head of the bolt 406 is disposed at a lower end of the elongate aperture 405. As the front legs 1B.1 move forward into the expanded state, the upper end of each brace 401, 402 is rotated backwards in direction R. As the braces 401, 402 rotate, the head of the bolt 406 is slidably guided toward the upper end of the elongate aperture 405 for a smooth transition. FIG. 19 shows the chair in the expanding state, with the braces 401, 402 mid rotation as the chair 400 is moving toward the expanded state and the head of the bolt 406 is slidably traversing the elongate aperture 405. FIG. 21 shows the chair 400 in the expanded state, with the head of the bolt 406 disposed at the upper end of the elongate aperture 405.

The dimensions of the elongate aperture 405, namely the length of the elongate aperture 405, must therefore be long enough to allow the front and back legs 1B.1 and 3B.1 to move away from one another into the expanded state. In the embodiment shown in FIGS. 18-21, the elongate aperture 405 extends from the upper end of the brace 401, 402 to approximately a third or half of the total length of the brace 401, 402. However, the skilled person will understand that the dimensions of the elongate aperture 405 can be adapted as required to allow suitable rotation of the braces 401, 402 in direction R.

The chair 400 of the fourth embodiment works similarly to the first embodiment, but incorporates the additional rotational movement of the braces 401, 402. In use, when the chair 400 is in the expanded state under load, the braces 401, 402 experience a tension. This tension reduces undesirable splaying or movement between the front and back legs 1B.1 and 3B.1 by locking the back legs 3B.1 into a stable position with respect to the front legs 1B.1. In this way, the braces 401, 402 provide additional strut supports to the chair 100 of the first embodiment, so as to improve the stability of the resulting chair 400.

Other embodiments can be adapted in a similar way.

The chairs of the above embodiments, particularly the fourth embodiment, may, in addition to their current configuration, include folding arms 40A, 40B which can be connected to the mainframe 1. The folding arms 40A, 40B are formed of at least one piece of material. Each folding arm 40A, 40B is formed of an arm support, which is the central portion 420 cut out of the folding arm 40A, 40B and an arm rest, which is the outer portion 410 which surrounds the central portion 420 in the folded position, wherein the central portion 420 and the outer portion 410 are connected together. The folding arms 40A, 40B can be connected to the seat supports 1.5 of the mainframe 1 using any appropriate connecting means (first connecting means), preferably a hinge or the like. When the folding arms 40A, 40B are connected to the mainframe 1 it is only possible to open the chair in one direction in order to deploy the folding arms 40A, 40B as arm rests.

Figure 22:
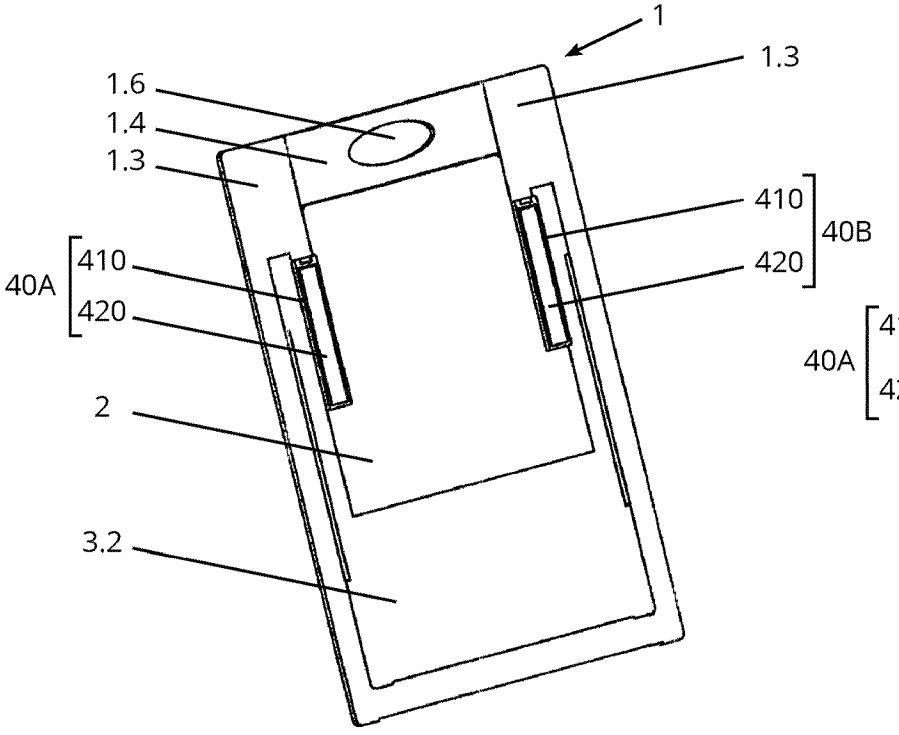
FIG. 22 is a perspective view of the modified chair of the any of the first to fourth embodiments in a collapsed state.
Figure 24:
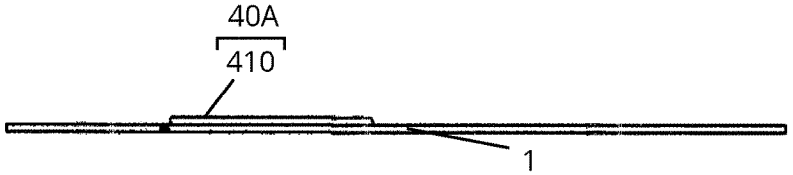
FIG. 24 is a side view of the modified chair of the any of the first to fourth embodiments in a collapsed state.

When the folding arms 40A, 40B are each comprised of one piece of material, a central portion 420 (arm support) is cut out and connected to the outer portion 410 (arm rest), which surrounds the central portion 420, by a second connection means, for example a hinge. The first connecting means connects one end of the outer portion 410 of the folding arms 40A, 40B to the seat supports 1.5. FIG. 22 depicts the modified chair in the collapsed state. In this state the first connection means allows the folding arms 40A, 40B to fold flat such that the folding arms 40A, 40B lie flat on top of the seat supports 1.5 in a plane above the plane of the mainframe 1, as shown in FIG. 24. The second connection means connects the inner surface of the outer portion 410 of the folding arms 40A, 40B to the central portion 420 of the folding arms 40A, 40B.

Figure 23:
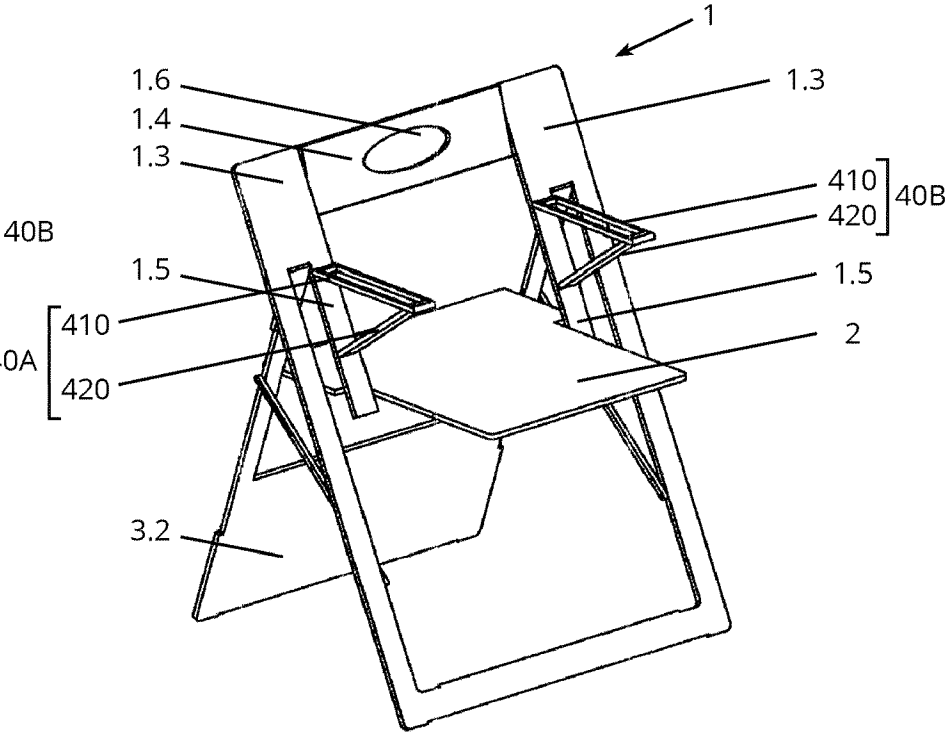
FIG. 23 is a perspective view of the modified chair of the any of the first to fourth embodiments in an expanded state.

When the chair is in an expanded state, as shown in FIG. 23, the outer portion 410 of the folding arms 40A, 40B extends from the first connection means away from the seat supports 1.5. The central portion 420 of the folding arms 40A, 40B extends back towards the seat supports 1.5 from the ends of the folding arms 40A, 40B that are not connected to the seat supports 1.5, forming folding arms 40A, 40B that form a triangular shape with the seat supports 1.5. The central portions 420 of the folding arms 40A, 40B, do not have to be connected to the seat supports 1.5 but may rest against them, thus providing support for the outer portions 410 of the folding arms 40A, 40B. Alternatively, the central portions 420 of the folding arms 40A, 40B, may be connected to the seat supports 1.5 in a detachable manner, either by using a push fit or spring loaded locking mechanism.

Figure 27:
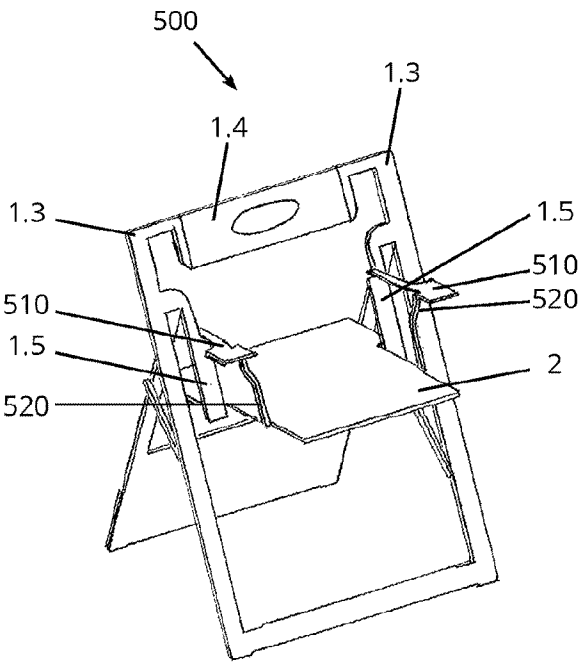
FIG. 27 is a perspective view of the chair of the fifth embodiment in a fully expanded state.
Figure 26:
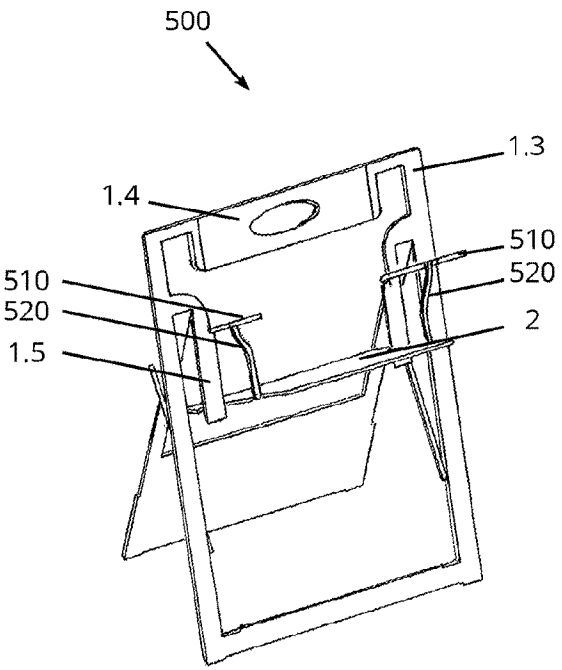
FIG. 26 is a perspective view of the chair of the fifth embodiment in a partially expanded state.
Figure 25:
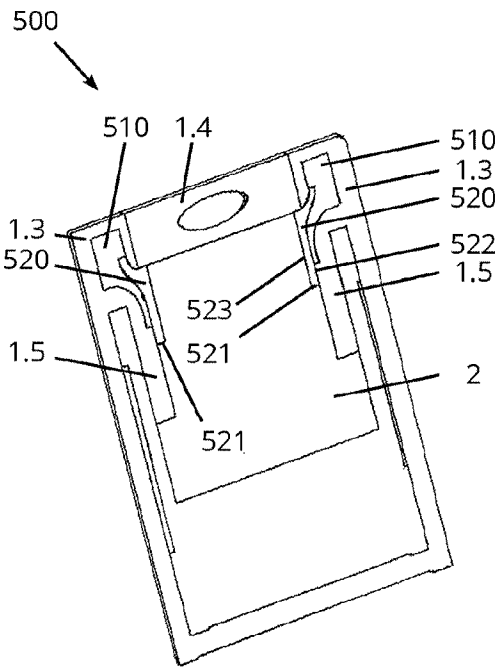
FIG. 25 is a perspective view of the chair of the fifth embodiment in a collapsed state.

FIGS. 25 to 27 depict the fifth embodiment of the present invention. The fifth embodiment is a modification of the chair of previous embodiments, wherein the seat supports 1.5, seat 2 and the upper connecting areas 1.3 have cut outs to form arm rests 510 and arm supports 520. This embodiment provides the advantage of having arms integrally incorporated in and within the plane of the tessellated UPFC allowing the arms to be included in the chair as tessellated components instead of attached separately. The arm rests 510 and arm supports 520 are integrally formed with the mainframe 1 and seat 2. FIG. 25 depicts the chair 500 of the fifth embodiment in the fully collapsed state. Here it can be seen that the configuration of the chair 500 is substantially the same as previous embodiments, in particular the first embodiment, and thus discussion of the common features has been omitted here.

As seen in FIG. 25, the lower end of the arm supports 520 is formed adjacent to the end of the seat supports 1.5 closest to the back rest 1.4, between the seat supports 1.5 and the seat 2. The arm supports have short sides 521, extending perpendicular to the seat supports 1.5 and located at the furthest point of the arm supports 520 from the back rest 1.4 and first long sides 522 which extends next to (and parallel to) the seat supports 1.5 from the short sides into the upper connecting areas 1.3 and towards the back rest 1.4. The arm supports 520 have second long sides 523, parallel to the first long sides 522 and next to the seat 2, that extend from the short sides 521 to the back rest 1.4 of the chair 500.

The first and second long sides 522, 523 of the arm supports 520 may remain equidistant from one another along the length of the arm supports 520. The arm supports 520 extend into the upper connecting areas 1.3 until they reach the part of the upper connecting areas 1.3 adjacent to the back rest 1.4 of the chair and then curve around the corner of the upper connecting areas 1.3 adjacent to the back rest 1.4 in a half "U" shape. To maintain equidistance between the first and second long sides 522, 523 of the arm supports 520 the second long sides 523 extend further than the first long sides 522. This allows the first long sides 522 to begin to curve around the corner of the upper connecting area 1.3 in the same manner as the second long sides 523 thus forming a half "U" shaped top portion of the arm support 520. This can be best seen in FIG. 29.

The arm rests 510, seen in FIGS. 25 to 28, also extend towards the upper side of the chair 500 similar to the arm supports 520. The lower portion of the arm rests 510 are cut into the seat supports 1.5 and are located between the arm supports 520 and the seat supports 1.5 when the chair 500 is in the fully collapsed position. The lower portion of the arm rests 510, formed in the seat support 1.5, extends towards the top of the chair 500, into the upper connecting areas 1.3. First sides 511 of the arm rests 510 curve around the first long sides 522 and second short sides 524 of the arm supports 520 and continue to extend towards the top of the chair 500, stopping to leave a frame in the upper connecting areas 1.3 between the top of the chair 500 and the arm rest main bodies 530. The main bodies 530 of the arm rests 510 are formed substantially in the upper connecting areas 1.3.

Second sides 512 of the arm rests 510, which extend from between the seat supports 1.5 and the arm supports 520 into the upper connecting areas 1.3, begin approximately parallel to the sides of the seat supports 1.5 and the arm supports 520 and curve away from the first sides 522 of the arm supports 520 as the second sides 512 of the arm rests enter the upper connecting areas 1.3. The first and second sides 511, 512 of the arm rests 510 are joined together by two perpendicular sides 540, 550 as shown in FIGS. 25 to 28 to form a partially rectangular shapes in the upper connecting areas 1.3.

Figure 29:
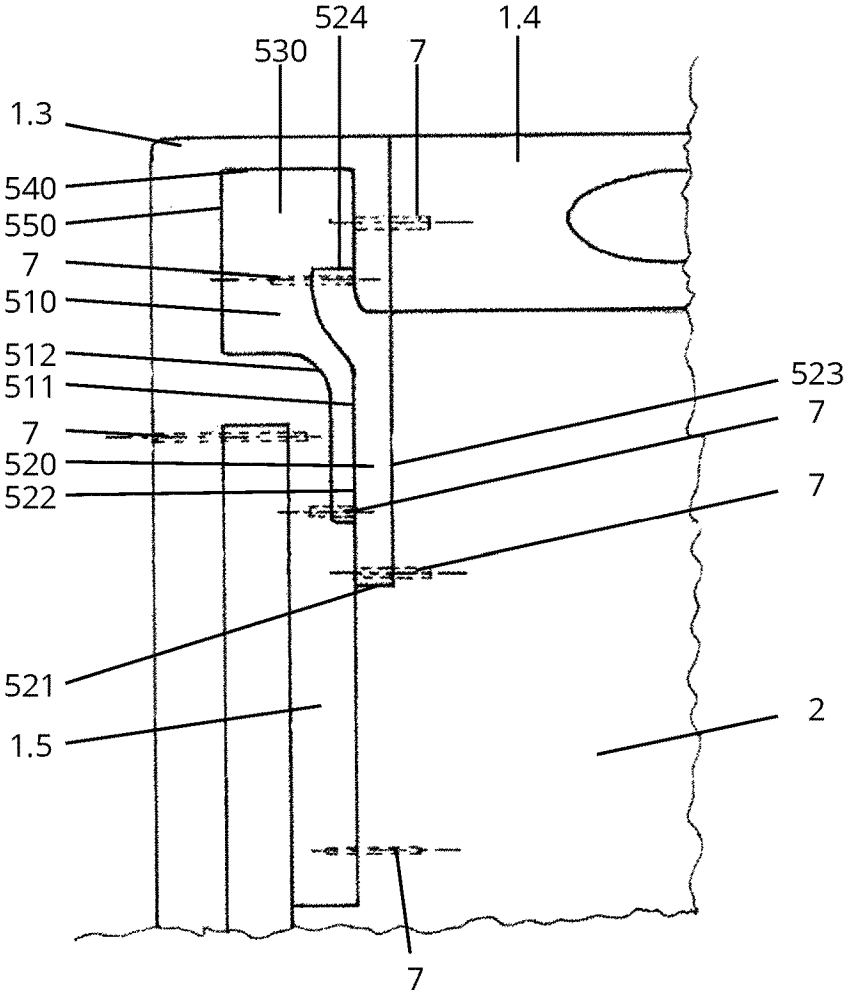
FIG. 29 is a front view of the chair of the fifth embodiment in a collapsed state showing the positioning of the connection means.

FIG. 29 again depicts the chair 500 of the fifth embodiment in the fully collapsed state in order to illustrate connections between the back rest 1.4, the upper connecting areas 1.3, the arm rests 510, the arm supports 520, and the seat supports 1.5. As will be discussed later, the back rest 1.4 may be connected to the upper connecting area 1.3 using a rods or dowels 7, similar to those seen in FIG. 10. This allows the back rest 1.4 to tilt/swivel. In FIG. 29 it is shown that the seat 2 can be connected to the lower portion of the seat supports 1.5 using a pin/rod/dowel 7 or other suitable connection means, and that the front legs 1.1 and back leg 3.1 can be connected to the top end of the seat supports 1.5 (furthest end from the floor) in the same manner as seen in FIG. 10.

Figure 28:
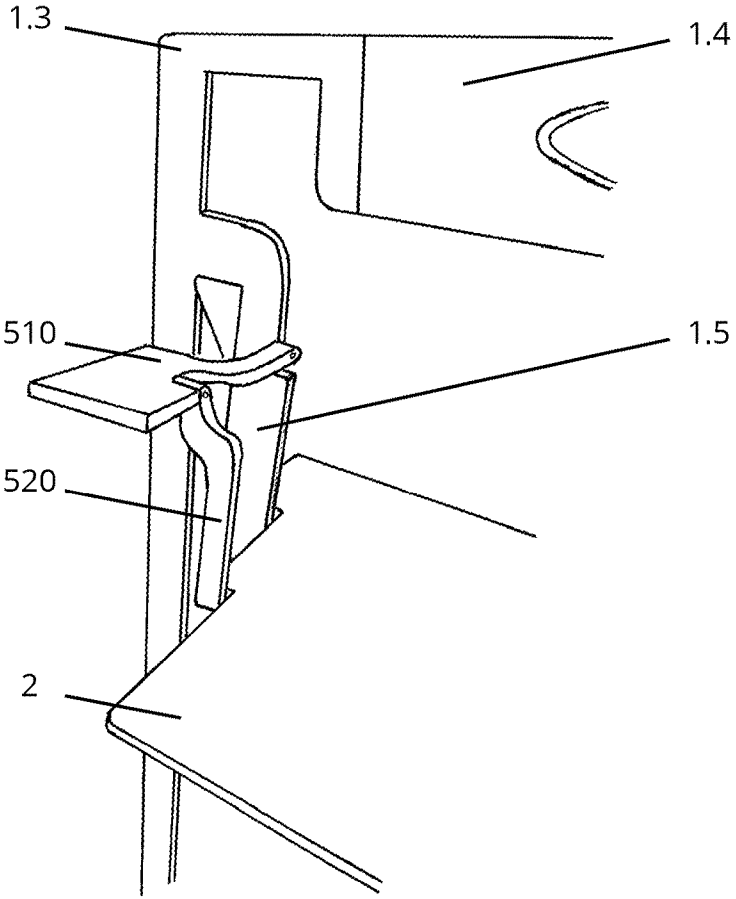
FIG. 28 is a perspective view of the arm rest of the chair of the fifth embodiment in a fully expanded state.

The lower portion of the arm supports 520 is connected to the seat 2 using a rod/dowel 7 or the like. The upper curved end of the arm supports 520 is connected, at the interface between the first long side 522 of the arm supports and the first long side 511 of the arm rests 510, to the main bodies 530 of the arm rests 510 using a rod, dowel or a pin 7. This provides a pivot point and connection between the arm supports 520 and the arm rests 510 allowing the end of the arm rests 510, that extends away from the seat supports 1.5, to be sufficiently stable and support the user's arm. The lower portion of the arm rests 510, which in FIGS. 25 and 28 are substantially parallel to and sandwiched between the seat supports 1.5 and the arm supports 520, are connected to the seat supports 1.5 using a rod, pin or dowel 7. This provides a connection between the arm rests 510 and the seat supports 1.5 allowing the elbow of the user to be supported when resting on the arm rests 510. Each of these pivot points allows the arm rests 510 and arm supports 520 to be pivoted in either direction thus allowing the chair 500 to be opened in either direction.

Next the movement of the arm rests 510 and arm supports 520 will be described in relation to FIGS. 26 to 28. FIG. 26 demonstrates the chair 500 of the fifth embodiment in a partially expanded state. As the front legs 1B.1 move forward into the expanded state and the seat 2 moves down, the lower ends of the arm supports 520 pivot about the connection to the seat 2 and are pulled down. In turn the upper portion of the arm supports 520, which are connected to the main bodies 530 of the arm rests 510, pivot about the rod, pin or dowel 7 and force the arm rests 510 to rotate forward. This causes the arm rests to pivot about their connection to the seat support 1.5 and move towards being perpendicular to the seat supports 1.5. As with the previous embodiments, the arm rests 510 and the arm supports 520 may open in either direction depending on the direction in which the seat 2 is opened. As can be seen in FIG. 26 this leaves cut outs in the upper connecting areas 1.3.

FIG. 27 shows the chair 500 of the fifth embodiment in the fully expanded state. As can be seen in FIG. 27 the seat 2 has rotated into the fully expanded state such that it is perpendicular to the floor. The arm supports 520 can be seen to be substantially perpendicular to the floor and support the arm rests 510. In the fully expanded state the arm rests 510 are supported by the arm supports 520 and are positioned approximately parallel to the floor. The lower portions of the arm rests 510, which are connected to the seat supports 1.5, may also rest on the seat supports 1.5 thus providing added stability and support for the user's arms. FIG. 28 shows an alternate perspective view of the arm rests 510 and arm supports 520 in the fully expanded state. In FIG. 28 the connection points between the seat 2, the arm supports 520, the arm rests 510 and the seat supports 1.5 can be more clearly seen.

The chair 500 or any of the previously discussed embodiments may have lower edges (the edges which come into contact with the floor) of the front legs 1.1 and back leg 3.1, that are shaped so that there are a plurality of, preferably four, points of contact with the floor. FIGS. 22 and 23 show examples of this. These legs are an alternative to the lower edges of the front legs 1.1 and back leg 3.1 being completely in contact with the floor. The four points of contact allow for improved stability of the chair 500 and serve to minimise damage to the floor by long 90-degree edges. The four points of contact are rounded to minimise the risk of damage to floors and may have synthetic inserts. These synthetic inserts may be rubberised/plastic inserts. In such a case, only the rubberised/plastic inserts will come into contact with the floor, which will again reduce the risk of damaging the floor.

Consequently, as illustrated by the various embodiments, the present invention provides a UPFC with the minimum of required main components, where the main components fit perfectly into each other to give an integrated plane when the seat is collapsed, and where the opening and closing process requires the direct movement of just one main part, with the other parts moving in a coordinated, articulated fashion. Some configurations advantageously allow for the chair to be opened in both directions, although this is not essential.

The present invention also provides a chair which allows one or both of its sides to be used as surfaces for printing. The surfaces may have all manner of printed images upon them, from abstract art and classic art reproductions to popular culture iconography. Alternatively, images could be etched or engraved onto the surfaces, if the material will allow.

Figure 30A:
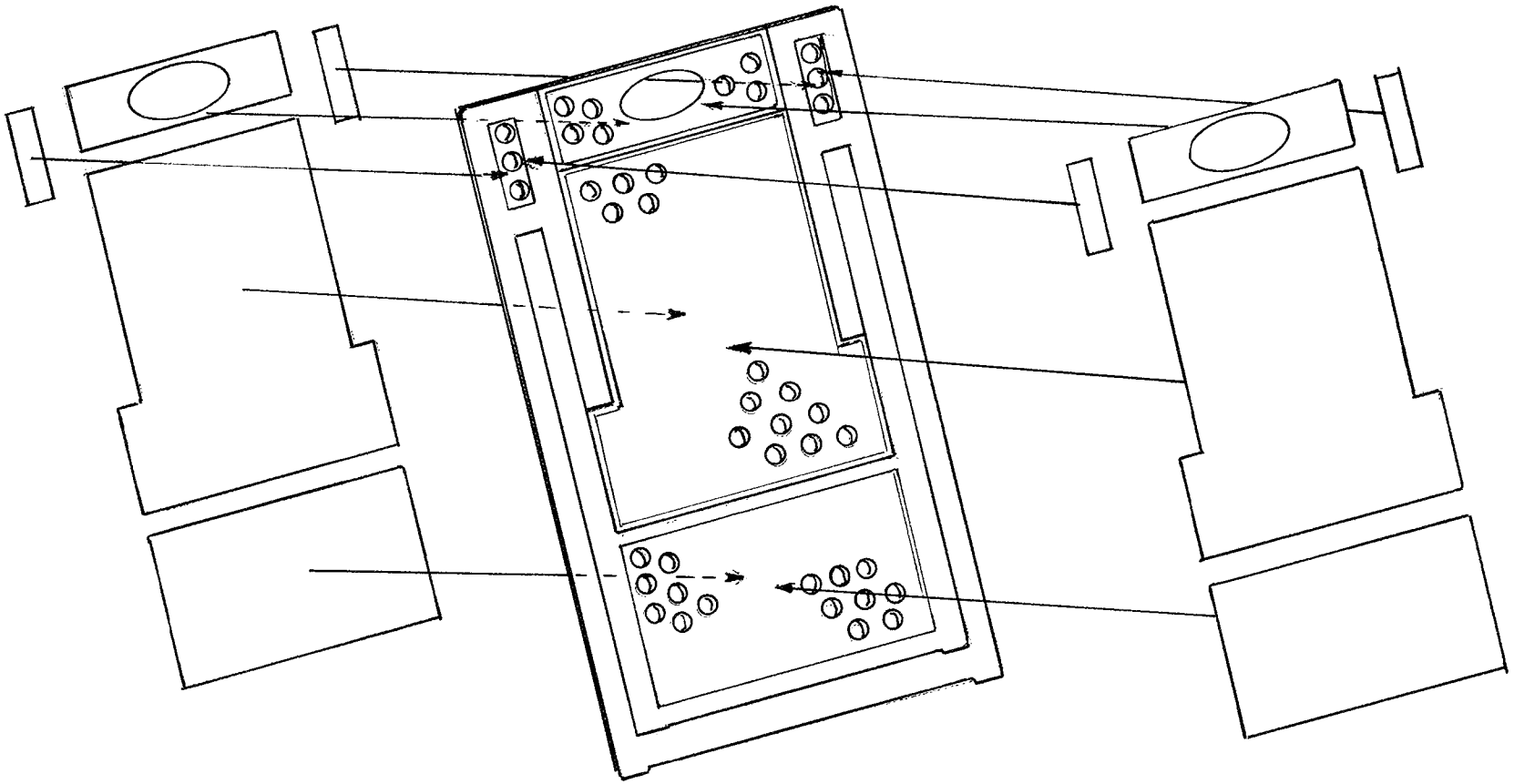
FIG. 30A is an exploded view showing a partial skeletal structure of the chair in a collapsed state in a modification which can be used in any of the embodiments.

In a further modification of the various illustrated embodiments, the chair may be configured to have a skeletal structure. In such a case each of the solid panels of the chair, such as the seat 2, the back rest 1.4, the back leg connecting area 3.2 and the upper connecting portions 1.3, may be cut out of the single piece of material such that only a frame remains. FIG. 30A shows an example of a partial skeletal version of the chair where portions of the panels are cut away to reduce the amount of material present in the chair and thus to reduce the weight of the chair. The sections of material removed in FIG. 30A are shown as circular cut outs, however, the material skeletal structure should not be limited to one with circular cut-outs as it is envisaged that any shape of cut out may be used that provides weight saving and stability. Other examples of cut outs include, but are not limited to, honeycomb, quadrilateral, triangular shapes. These shapes may be arranged to form a pattern, to give an aesthetic or structural effect, however this is not essential. This process may allow for highly decorative images and patterns.

The cut outs of this weight saving modification may extend all or part of the way through the single material of the chair, may vary in depth and size, and may be present on one or both sides of the panels. Furthermore, the skeletal structure may be formed on all or only parts of the chair; for example only on the seat 2 or only on the backrest of the chair.

Alternatively or in addition, all of the flat surface areas of the chair may be removed leaving only a frame around the edge of each part of the chair; for example, a frame for seat 2, the back rest and back leg connecting area 3.2. This is shown in FIG. 30A as a frame running around the edge of the seat 2 and the back rest of the chair. The remaining frame may then be skinned using panels selected, from a range, by the user. The panels would be designed to fit the shape of the frames of each section of the chair and could be detachable and interchangeable with different designs or made of different materials. The skeletal structure of the chair would not affect the folding of the chair as the frames would be connected in the same manner as the solid panels and in the same places, using the same connecting means.

Although the full skeletal structure may take the form of an outer frame surrounding each of the panels of the chair as demonstrated in FIG. 30A, it is also possible to form the chair of a partial skeletal structure. The partial skeletal structure allows substantial portions of the large flat areas to be machined such that recesses of a set depth remain on one or both sides of the large flat areas of the chair. In these recesses, which do not extend all the way through the material of the chair, panels like the ones shown on either side of FIG. 30A may be fitted. The recessed portions machined into the material of the large flat areas of the chair mirror the depth of the panels that can be applied to the recesses. The panels are therefore held in place by a portion which is frame-like and that forms part of the same area as the recessed portion but has not been machined to be a recess. The use of a recess is not essential and panels could also be (preferably removably) press-fitted using studs or other fixings. FIG. 30A shows examples of where said panels, where provided, may be applied to the chair, in particular that the panels may be applied to one or both sides of the chair. The panels of FIG. 30A could be formed of any suitable material, some examples of which include metals, timbers, plastics (including transparent plastics, allowing the user to see the machined pattern/image in the chair) and carbon fibre. The panels are fixed by any suitable method for example by gluing or being screwed to the frame or recess of the chair.

The chair with a full or partial skeletal structure provides the advantage of saving weight while maintaining structural integrity as well as allowing for a number of different finishes to be applied to the chair.

The chair of the various embodiments is created by the tessellation of components (tiles) in a plane, where the first and second embodiment uses three tiles: the mainframe, back leg component and seat. The third embodiment in FIG. 17, also uses three tiles. The chair in FIG. 18 employs five tiles, and the chair in FIG. 25 employs ten tiles.

The thickness of each of the tiles should be understood to be the length of the side seen in a side view and perpendicular to the large flat surfaces which can be seen from a plan view. Absent any connections between them, the individual tiles in their tessellated arrangement would be moveable in a direction perpendicular to the single plane (plane viewed from a side view) of the chair without disturbing any other tiles. This feature also allows tiles (or in the case of the chair, individual main components) to pass each other unimpeded when the chair is moving between the collapsed/folded and expanded states. Of course, the thicker the tiles become, the more the need for walls of each tile to be curved or angled slightly, to avoid corners of tiles from contacting each other.

As seen in the side view perspectives, all the tiles (now with a thickness) which make the chair are of the same depth. While this is preferable to allow the chair to be made from sheet material of uniform thickness and allows for maximum storage efficiency, it is not essential. The tiles (main components) of the chair may vary in thickness in comparison to others. For example, material may be taken away from the back rest or seat to create curved areas or to add padding to the seat or back rest for the purpose of improved comfort. These modifications will not alter or break the theoretical underpinning principles of tessellation of the chair.

In such cases where modifications have been made, say, either taking material away, or adding material which would cause a change in thicknesses between individual tiles (main components), when viewed from a side view, the user will see a difference in thickness between various tiles. This, however, does not affect the appearance of the chair when seen from a plan view as the tile(components) will still tessellate with each other and not overlap, as has been previously defined. Therefore, if the chair is modified in this manner it will still be a uni-planar folding chair and enjoy the advantages previously discussed.

Moreover, the present invention provides a chair that can be constructed with the minimum of machining processes and with limited points of pivoting and/or hinging and areas of sliding (using slots or grooves). No part of the transformation process between collapsed and expanded states and vice versa requires the user to guide any parts in any way (except for the one movement necessary for the transformation to take place).

Any suitable material or materials can be used to manufacture any parts of the chair, and the same or different materials can be used to make the various parts of the chair. Preferably, the three main components are all made of the same material, and more preferably they are all formed of the same sheet of material. It is preferred that aircraft grade aluminium be used from the point of providing a strong, rigid, thin and relatively lightweight chair, although other metals such as carbon fibre, titanium and steel can be used. In addition, the main components can be made of wood, plastic or a combination of any two or more of metal, wood and plastic.

In embodiments where the mainframe 1 and back leg support 3 are made from a plastic material, it is possible to form a hinge between the mainframe 1 and the back leg support 3 by machining or cutting along the top of the back leg 3.1 and the upper connecting area 1.3 so as to leave them connected while allowing the back leg support 3 to swing against the mainframe 1. Since the mainframe land the back leg support 3 are formed of the original sheet material, the hinge can be formed without the use of rods 4, 5.

The chair of the various embodiments previously described may be so configured that the back rest 1.4 can rotate/swivel between the upper connecting areas 1.3. In this configuration the back rest 1.4 is connected to the mainframe 1, in particular the upper connecting areas 1.3, using rods, pins, dowels or bolts 7 as seen in FIG. 29. The back rest 1.4 may be kept in the same plane as the upper connecting areas 1.3 using magnetic components (magnets) comprised of a first magnet placed on the bottom edge of the back rest and a second magnet placed on the top edge of the seat 2. This advantageously helps the chair from expanding unintentionally as the magnets will keep the seat in the same plane as the mainframe 1, unless intentionally pushed to allow the chair to move between the collapsed and the expanded positions.

Additional magnetic components may also be placed on the side edges of the back rest 1.4 and side edges of the seat 2 and corresponding areas on the mainframe 1 if additional attractive magnetic force is needed in order to prevent the chair from undesirably moving between the collapsed and expanded positions when no force is applied. Ball fittings as described above, or any other suitable means, can also be used.

A further modification to the chair of the various embodiments described above is that the chair may be configured to be mounted on a wall, or wall mountable, by including a wall mounting means. The excess material from the making of the handle hole may be utilised in the making of the wall mounting means. In order to allow the chair to be mounted on a wall, there may be at least one hole located in the back rest 1.4, upper connecting areas 1.3, front legs 1.1 or back leg 3.1. The at least one hole may extend all or part of the way through the material of the chair and allow the chair to be hooked onto a wall bracket or other protrusion.

Alternatively, a hook shape may be cut out of the material that forms the back rest 1.4, front legs 1.1 or back leg 3.1. This hook can be located centrally such that the chair can be hung on a bracket or other protrusion.

A further alternative is that it is possible to use the left-over material created from cutting out the handle-hole (in the case of the chair in the figures, an elliptically shaped sheet of material). This left-over material could be employed as part of the wall bracket, so that when the chair is hung, the handle-hole is filled with the elliptical sheet material, which may be fixed to a wall, when the chair is hung. The handle-hole wall bracket will look like a sheet of material attached to and against a wall, with no obvious holes or hooks visible. It may be formed with a slight lip on the upper edge of the elliptical material so that the chair can be safely hung from handle-hole bracket, without it slipping off. Of course, the shape of the handle-hole of the chair, and thus the wall bracket, is not limited to elliptical and may be any shaped polygon.

The foregoing description has been given by way of example only and it will be appreciated by a person skilled in the art that modifications can be made without departing from the scope of the present invention as defined by the claims.

The invention claimed is:

1. A folding chair comprising as main components a mainframe, a seat and a back leg support, wherein:

at least one of said main components is substantially uniplanar and the other said main components fit within a plane of the at least one main component when the chair is in a collapsed state;

the folding chair uses a construction, wherein forward movement from the collapsed state of the folding chair of a top of the seat relative to the mainframe causes the back leg support to move backwards relative to the mainframe for unfolding the folding chair;

the mainframe comprises a backrest and plural front legs extending downwards from outer sides of the backrest and seat supports spaced inwards from the front legs and also extending downwards from the backrest partially along with the front legs and defining spaces between the front legs and seat supports;

the seat is pivotally attached to the seat supports; and wherein the back leg support comprises a pair of back legs, each of which is disposed in one of the spaces between a corresponding front leg and seat support when the chair is collapsed; and the seat supports extend from the backrest partially down the back leg support, when the chair is collapsed, and connect to the seat.

2. A folding chair according to claim 1, wherein the seat supports extend at least halfway down a length of the seat when the chair is collapsed.

3. A folding chair according to claim 1, wherein:

the back leg support is pivotally mounted to the front legs;

the seat is pivotally mounted to the seat supports; and the seat is pivotally and slidably mounted to the back leg support.

4. A folding chair according to claim 1, wherein the seat and the back leg support are nested within the mainframe when the chair is collapsed such that when viewed from a plan view the back leg support and the mainframe do not overlap.

5. A folding chair according to claim 1, wherein the mainframe comprises front legs extending downwards, the back leg support is pivotally attached to upper pivot points adjacent the front legs, and the seat is pivotally attached to the front legs below the upper pivot points.

6. A folding chair according to claim 1, wherein the front legs on either side of the chair are joined by a connecting portion extending between them at either or both a top or a bottom of the chair when collapsed.

7. A folding chair according to claim 6, wherein the front legs are joined by a backrest.

8. A folding chair according to claim 6, wherein the front legs are joined by a front leg connecting area extending between bottoms of the respective front legs.

9. A folding chair according to claim 1, wherein the mainframe, the seat and the back leg support form a substantially flat surface on at least one side when the chair is collapsed.

10. A folding chair according to claim 1, wherein the chair can be opened in either direction.

11. A folding chair according to claim 1, wherein each of the mainframe, the back leg support and the seat is integrally formed.

12. A folding chair according to claim 1, wherein one sheet of material is used to form all the mainframe, the back leg support and the seat.

13. A folding chair according to claim 1, further comprising a brace having an upper end attached to the back leg support and a lower end rotatably attached to a front leg.

14. A folding chair according to claim 13, wherein:

the back leg support comprises a connection means, protruding therefrom, the upper end of the brace comprises an elongate aperture configured to slidably engage with the connection means such that the connection means can slide from an upper end to a lower end of the elongate aperture, in the folded state, the connection means is disposed at the lower end of the elongate aperture, and in the expanded state, the connection means is disposed at the upper end of the elongate aperture.

15. A folding chair according to claim 13, wherein the back leg support comprises a cutout portion configured to accommodate the brace, such that in the folded state, the brace is flush with the back leg support.

16. A folding chair according to claim 14, wherein the connection means is flush with a side of the brace.

17. A folding chair according to claim 1, further comprising folding arms connected to the mainframe.

18. A folding chair according to claim 17, wherein the folding arms are formed of an arm support, being a central portion cut out of the folding arm, and an outer portion, which surrounds the central portion, wherein the central portion and the outer portion are connected together.

19. A folding chair according to claim 1, wherein the chair has a skeletal structure and at least one panel is detachably fitted to the skeletal structure at least in part.

20. A folding chair according to claim 1, further including a wall mounting means.

* * * * *